US010051972B2

(12) United States Patent
Nakamura et al.

(10) Patent No.: US 10,051,972 B2
(45) Date of Patent: Aug. 21, 2018

(54) MATTRESS

(71) Applicant: Sumitomo Riko Company Limited, Aichi (JP)

(72) Inventors: Yasuhiro Nakamura, Aichi (JP); Hiroshi Yamada, Aichi (JP); Tomonori Hayakawa, Aichi (JP); Akitsugu Misaki, Aichi (JP)

(73) Assignee: SUMITOMO RIKO COMPANY LIMITED, Aichi (JP)

( * ) Notice: Subject to any disclaimer, the term of this patent is extended or adjusted under 35 U.S.C. 154(b) by 0 days.

(21) Appl. No.: 15/793,615

(22) Filed: Oct. 25, 2017

(65) Prior Publication Data

US 2018/0042396 A1 Feb. 15, 2018

Related U.S. Application Data

(63) Continuation of application No. PCT/JP2016/066302, filed on Jun. 1, 2016.

(30) Foreign Application Priority Data

Oct. 30, 2015 (JP) ..... 2015-214022

(51) Int. Cl.
*A47C 27/14* (2006.01)
*A47C 27/10* (2006.01)
*A47C 17/165* (2006.01)

(52) U.S. Cl.
CPC ..... *A47C 27/10* (2013.01); *A47C 17/165* (2013.01)

(58) Field of Classification Search
CPC ..... A47C 27/10
USPC ..... 5/710, 713, 722, 657
See application file for complete search history.

(56) References Cited

U.S. PATENT DOCUMENTS

| | | | | |
|---|---|---|---|---|
| 5,243,722 | A * | 9/1993 | Gusakov | A47C 7/021 297/DIG. 3 |
| 8,745,797 | B2 | 6/2014 | Misaki et al. | |
| 8,959,685 | B2 | 2/2015 | Misaki et al. | |
| 9,021,638 | B2 | 5/2015 | Misaki | |
| 2006/0085919 | A1 | 4/2006 | Kramer et al. | |
| 2011/0004998 | A1 | 1/2011 | Losio | |
| 2013/0263379 | A1 | 10/2013 | Misaki et al. | |

OTHER PUBLICATIONS

Kouchi et al., "AIST Anthropometric Database", National Institute of Advanced Industrial Science and Technology, H16PRO 287, Jan. 2005, with English language translation.

(Continued)

*Primary Examiner* — Fredrick C Conley
(74) *Attorney, Agent, or Firm* — Greenblum & Bernstein, P.L.C.

(57) ABSTRACT

A mattress including: substrates configured to support a human body; and a plurality of cells arranged on an upper face of each substrate, the cells including respective fluid chambers. The substrates are divided from each other at a location corresponding to a folding part provided to a portion of a bed in a length direction thereof such that cell units are constituted by the respective substrates and the cells arranged thereon. The cell units are disposed such that the cell units are adjacent to each other with the folding part interposed therebetween. A connecting body is disposed between the cell units such that the connecting body straddles the cell units and is supported by the cells of the cell units.

14 Claims, 18 Drawing Sheets

(56) References Cited

OTHER PUBLICATIONS

International Preliminary Report on Patentability for PCT/JP2016/066302, dated May 11, 2018, with English language translation.

* cited by examiner

MATTRESS

INCORPORATED BY REFERENCE

This application is a Continuation of International Application No. PCT/JP2016/066302 filed Jun. 1, 2016, which claims priority under 35 U.S.C. §§ 119(a) and 365 of Japanese Patent Application No. 2015-214022 filed on Oct. 30, 2015, the disclosures of which are expressly incorporated herein by reference in their entireties.

BACKGROUND OF THE INVENTION

1. Field of the Invention

The present invention relates to a mattress adapted for use as a nursing care bed and the like.

2. Description of the Related Art

Conventionally, with the aim of preventing bedsores of elderly persons, physically disabled persons etc. who find it difficult to turn over in sleep and the like, there have been proposed a mattress including a substrate for supporting a human body, and a plurality of cells arranged thereon. Such a mattress is disclosed in, for example, U.S. Publication No. US 2013/263379, and by adjusting pressure that acts on the body of the user (body pressure) through inlet and outlet adjustment of the fluid within the cells, prevention of bedsores and the like is expected owing to dispersion of the body pressure.

Meanwhile, some nursing care beds have a back-raising function for raising the upper body of the user at mealtimes or the like. A mattress adapted for use as a bed with such a back-raising function is preferably configured to be bent at a folding part by the back raising of the bed.

However, with respect to the bending operation of the mattress, it is still hard to say that sufficient examination has been conducted.

SUMMARY OF THE INVENTION

The present invention has been developed in view of the above-described matters as the background, and it is an object of the present invention to provide a mattress with a novel structure which is able to obtain stabilization of performance of the cells as well as excellent comfort of sleeping while realizing back-raising operation of the bed.

The above and/or optional objects of this invention may be attained according to at least one of the following modes of the invention. The following modes and/or elements employed in each mode of the invention may be adopted at any possible optional combinations.

The inventors considered that, in order to allow the mattress readily to follow the back raising of the bed so as to reduce compression to the user, it would be effective for the mattress to have a novel structure including cell units that are adjacent to each other at the location of the mattress corresponding to the folding part such that the cell units are tilted relative to each other during the back raising of the bed. In particular, by providing the cell units with a structure in which a plurality of cells are arranged on substrates divided at the folding part, dispersion of the body pressure can be achieved at the buttocks or the like where a large pressure is likely to act on the user.

However, further examination and tests conducted by the inventors as to the mattress having such a divided structure have revealed that, in some cases, support of the user may be insufficient at the folding part in the state of back raising.

Specifically, it is desired to obtain a large surface of the mattress for supporting the user even at the time of the back raising of the bed so as to realize good comfort of sleeping and the like. Therefore, the inventors examined, for example, one mode with a structure in which the cell units tilt relative to each other around a point situated above the bed during the back raising thereof. With this structure, as depicted in a mattress 100 of FIG. 23, a gap 64 that becomes larger toward the lower side will be formed between cell units 16*a*, 16*b* during the back raising, and there is a risk that the user's buttocks may get caught in the gap, resulting in an ineffective support by the mattress. In particular, since the pressure acting on the vicinity of the user's buttocks becomes higher during the back raising of a bed 11, the fluid within cells 22 arranged in the vicinity of a folding part 62 will be adjusted to discharge, thereby permitting the cells 22 increased amount of deformation. As a result, the user's buttocks etc. are likely to get caught in the gap 64 between the cell units 16*a*, 16*b*, which may cause troubles of bottoming out or the like. It should be appreciated that the mode shown in FIG. 23 is not a precondition of the present invention, nor the one that limits the present invention or the target of the present invention, the same as FIGS. 1-22 described later.

Here, a first mode of the present invention provides a mattress comprising: substrates configured to support a human body; and a plurality of cells arranged on an upper face of each substrate, the cells including respective fluid chambers, wherein the substrates are divided from each other at a location corresponding to a folding part provided to a portion of a bed in a length direction thereof such that cell units are constituted by the respective substrates and the cells arranged thereon, the cell units are disposed such that the cell units are adjacent to each other with the folding part interposed therebetween, and a connecting body is disposed between the cell units such that the connecting body straddles the cell units and is supported by the cells of the cell units.

With the mattress constructed according to the first mode, the adjacent portions (divided portions) of the cell units advantageously realize the back-raising operation of the bed. Besides, owing to the connecting body, performance of the cells will be stabilized or the like, thereby improving comfort of sleeping and so forth.

A second mode of the present invention provides the mattress according to the first mode, wherein the cells have an upper-lower two-stage structure that includes a constricted part at a vertically medial portion whose cross-sectional shape is made small, and the connecting body is attached to the constricted part of the cells.

According to the second mode, the cells have the upper-lower two-stage structure including the constricted part. This makes it possible to efficiently change the height dimensions of the cells with respect to adjustment of the amount of fluid within the fluid chambers, thereby advantageously realizing dispersion of the body pressure through the adjustment of the heights of the cells.

Moreover, while the cells of upper-lower two-stage structure having the constricted part are likely to tilt (displace in the direction of collapse) due to action of the user's weight, by interconnecting the cells of both cell units that are adjacent to each other with the folding part interposed therebetween by using the connecting body, the tilt of the cells can be moderately limited. This may lead to stabilization of the upper face of the mattress by avoiding an excessive gap between the cells. In particular, with the cells of upper-lower two-stage structure, with respect to input of up/down load, deformation in a wobble manner for which the upper part than the constricted part tilts relative to the lower part is likely to occur. However, by the tilted upper part coming into contact with the connecting body during the wobble deformation, the amount of tilt will be limited, so that stabilization of the upper face of the mattress can be expected owing to prevention of excessive wobble deformation.

In addition, since the connecting body is attached to the constricted part of the cells, even when the downward load acts on the connecting body, the connecting body will be supported above the substrates by the lower part of the cells that is larger than the constricted part. Thus, bottoming out is less prone to occur.

A third mode of the present invention provides the mattress according to the first or second mode, further comprising a displacement limiting member that limits an amount of relative displacement of the cells within the cell units.

According to the third mode, the amount of relative displacement of the cells within the cell units due to relative tilt or the like will be limited by the displacement limiting member. This makes it possible to avoid an excessive gap between the cells within the cell units, thereby preventing the user from getting caught in the gap. In particular, by arranging the displacement limiting member such that the cells to which the connecting body is attached, on which a large force acts during the back raising etc., and other cells are connected to each other, dispersion of the load to each cell can also be achieved.

Furthermore, by the displacement limiting member being supported by the cells, the gaps among the cells within the cell unit are entirely or partially covered, so that the user's body caught in the gap will be supported by the displacement limiting member, thereby avoiding occurrence of bottoming out.

A fourth mode of the present invention provides the mattress according to the third mode, wherein the cells have an upper-lower two-stage structure that includes a constricted part at a vertically medial portion whose cross-sectional shape is made small, and the displacement limiting member is attached to the constricted part of the cells.

According to the fourth mode, the cells have the upper-lower two-stage structure including the constricted part. This makes it possible to efficiently change the height dimensions of the cells with respect to adjustment of the amount of fluid within the fluid chambers, thereby advantageously realizing dispersion of the body pressure through the adjustment of the heights of the cells.

Besides, while the cells of upper-lower two-stage structure having the constricted part are likely to tilt (displace in the direction of collapse) due to action of the user's weight, by interconnecting the cells of the cell units by using the displacement limiting member, the tilt of the cells can be limited. This may lead to stabilization of the upper face of the mattress by avoiding an excessive gap between the cells. In particular, with the cells of upper-lower two-stage structure, with respect to input of up/down load, deformation in a wobble manner is likely to occur. However, by the tilted upper part coming into contact with the displacement limiting member during the wobble deformation, the tilt will be limited, so that stabilization of the upper face of the mattress can be expected owing to prevention of excessive wobble deformation.

Additionally, since the displacement limiting member is attached to the constricted part of the cells, even when the downward load acts on the displacement limiting member, the displacement limiting member will be supported above the substrates by the lower part of the cells whose diameter is larger than that of the constricted part. Thus, bottoming out is less prone to occur.

A fifth mode of the present invention provides the mattress according to the third or fourth mode, wherein the displacement limiting member is linked to another member such that an amount of movement of the displacement limiting member is limited on the cell units.

According to the fifth mode, the displacement limiting member is linked to another member such as a base of the mattress that is placed on the bed. Thus, movement of the displacement limiting member is limited on the cell units, so that the amount of the movement of the cells will also be limited. This may lead to stabilization of the upper face of the mattress that supports the human body and any other effect.

A sixth mode of the present invention provides the mattress according to any one of the third through fifth modes, wherein the displacement limiting member has flexibility.

According to the sixth mode, since displacement or deformation of the cells connected by the displacement limiting member is permitted by flexural deformation of the displacement limiting member, dispersion of the body pressure can be advantageously realized. In particular, in the case of adopting the cells of upper-lower two-stage structure as shown in the fourth mode, the cells linked by the displacement limiting member are each permitted deformation in the vertical direction owing to the deformation of the displacement limiting member. Thus, differential of the amount of deformation between the cells with respect to input of the downward load can be significantly allowed, thereby advantageously obtaining body pressure dispersion effect.

A seventh mode of the present invention provides the mattress according to the sixth mode, wherein the displacement limiting member has extension and contraction properties.

According to the seventh mode, it is possible to limit excessive relative displacement of the cells connected by the displacement limiting member, while permitting their relative displacement to some extent owing to extensional and contractive deformation of the displacement limiting member. In particular, as shown in the fifth mode, in the structure in which the displacement limiting member is linked to another member as well, deformation of the cells can be permitted by extensional and contractive deformation of the displacement limiting member. Also, by providing the displacement limiting member such that the cells to which the connecting body is attached and other cells are connected, the force acting on the cells to which the connecting body is attached will be distributed to the other cells within the cell unit owing to the extension and contraction properties of the displacement limiting member. Thus, the upper face of the mattress is stably kept supporting the user.

An eighth mode of the present invention provides the mattress according to any one of the first through seventh modes, wherein the connecting body has flexibility.

According to the eighth mode, flexural deformation of the connecting body allows tilt or deformation of the cells to some extent, thereby advantageously attaining dispersion of the body pressure.

A ninth mode of the present invention provides the mattress according to the eighth mode, wherein the connecting body has extension and contraction properties.

According to the ninth mode, extensional and contractive deformation of the connecting body allows tilt or deformation of the cells to some extent, thereby advantageously attaining dispersion of the body pressure.

A tenth mode of the present invention provides the mattress according to the eighth or ninth mode, wherein the connecting body comprises a sheet that includes a plurality of holes through which the cells are inserted.

The tenth mode makes it possible to easily attach the connecting body to the plurality of cells. In particular, when combining the present mode with the cells of upper-lower two-stage structure including the constricted part described in the second mode, by inserting the constricted parts of the cells into the holes of the connecting body, the connecting body can also be easily attached to the cells.

Furthermore, since the connecting body has at least one of flexibility and extension/contraction properties, dispersion of the body pressure will be advantageously achieved. Besides, errors in position or size of the holes of the connecting body, or in disposition position, shape, size etc. of the cells are permissible owing to deformation of the connecting body. Thus, manufacturing operation of the cell units becomes easy.

An eleventh mode of the present invention provides the mattress according to any one of the first through tenth modes, wherein the cell units that are adjacent to each other with the folding part interposed therebetween in the length direction of the bed are continuous entirely in a width direction of the bed.

According to the eleventh mode, followability to back raising of the bed through relative tilt of the cell units will be sufficiently ensured with a simple structure.

A twelfth mode of the present invention provides the mattress according to any one of the first through eleventh modes, further comprising a division unit that is distinct from the cell units and is divided at a location away from the folding part in the length direction of the bed.

According to the twelfth mode, the mattress has a structure equipped with three or more units including not only the cell units but also the division unit. This makes it possible to provide each unit with characteristics or construction depending on the parts of the human body to support, thereby realizing improvement of body pressure dispersion effect, more stable support, simplification of structure, and the like. Specifically, for example, with respect to the portion for supporting a head part and the portion for supporting leg parts for which the body pressure is likely to be small, by adopting the division unit formed of soft block material such as polyurethane, the structure can be simplified.

A thirteenth mode of the present invention provides the mattress according to any one of the first through twelfth modes, wherein the cell units each include the cells that are arranged in a plurality of rows in the length direction of the bed and in a plurality of columns in a width direction of the bed.

Whereas the cells of the cell unit may be arranged in a single row or a single column in the length direction or width direction of the bed, at the time of manufacturing or exchanging the cells and the like, it is more efficient to provide the cells in the cell unit in a plurality of rows in the length direction of the bed and in a plurality of columns in a width direction of the bed.

Moreover, when the structure described in the present mode is adopted in combination with the structure described in each of the third through seventh modes, the displacement limiting member limits the amount of relative displacement or the amount of relative deformation of each cell within the cell unit. Thus, a large support surface can be sufficiently set by means of each cell unit while stabilizing the said support surface.

According to the present invention, the portions of the mattress that are adjacent to each other with the folding part interposed therebetween are constituted by the cell units whose substrates are divided at the folding part, and through relative tilt of the cell units, it is possible to advantageously realize back-raising operation of the bed. Besides, the connecting body is provided between the cell units that are adjacent to each other with the folding part interposed therebetween so as to connect the cells of the cell units to each other. Therefore, the user will be prevented from falling in the folding part owing to stabilization in performance of the cells, stable support of the user, or the like.

BRIEF DESCRIPTION OF THE DRAWINGS

The foregoing and/or other objects, features and advantages of the invention will become more apparent from the following description of embodiments with reference to the accompanying drawings in which like reference numerals designate like elements and wherein.

DETAILED DESCRIPTION OF EMBODIMENTS

Embodiments of the present invention will be described below in reference to the drawings.

Figure 1:
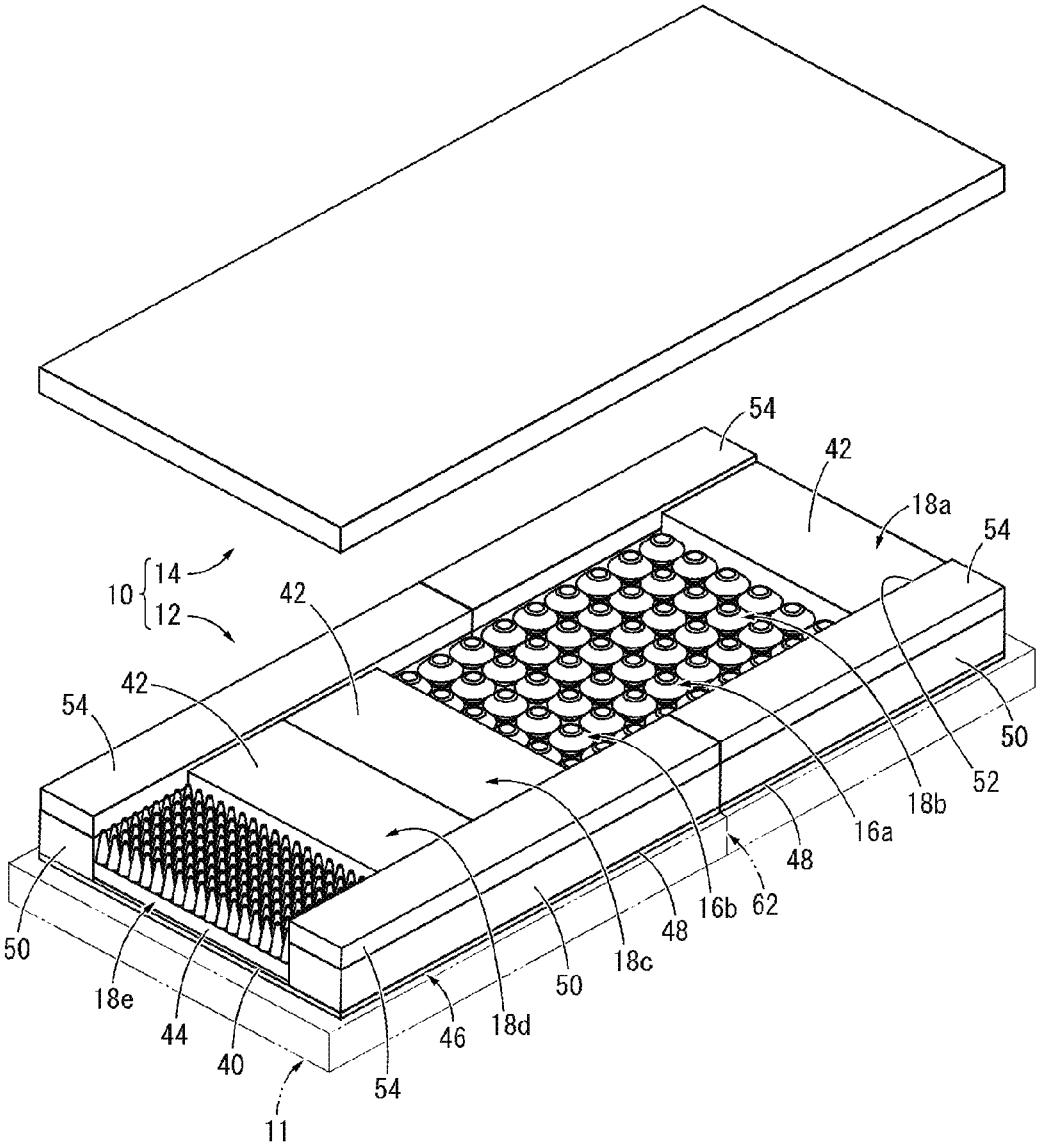
FIG. 1 is an exploded perspective view showing a mattress according to a first embodiment of the present invention.

FIG. 1 depicts a mattress 10 according to a first embodiment of the present invention. The mattress 10 is constituted by combining a mattress main body 12, which is configured to be spread on a bed 11, and a lid body 14 that covers the upper face of the mattress main body 12. In FIG. 1, the mattress main body 12 and the lid body 14 are depicted so as to be vertically remote from each other for illustrative purposes.

Figure 2:
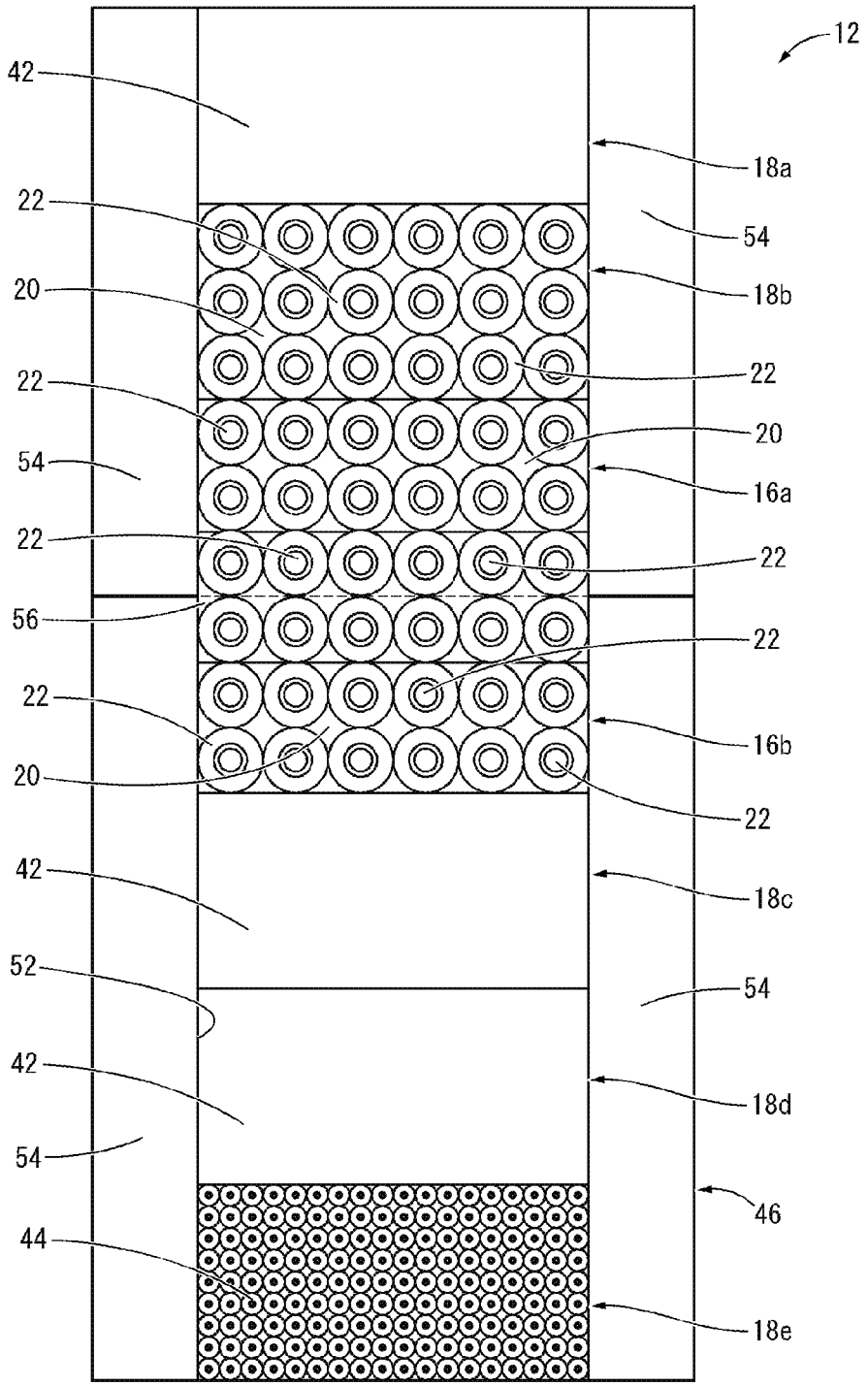
FIG. 2 is a top plan view of a mattress main body of the mattress shown in FIG. 1.

Described more specifically, as shown in FIGS. 1 and 2, the mattress main body 12 includes two cell units 16*a*, 16*b* and five division units 18*a*, 18*b*, 18*c*, 18*d*, 18*e*.

Figure 3:
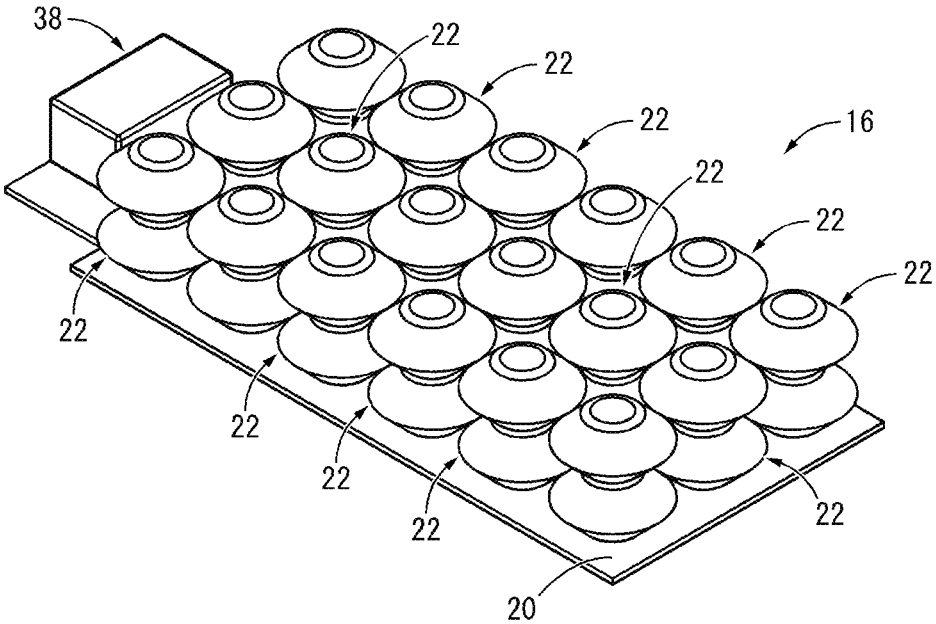
FIG. 3 is a perspective view of a cell unit of the mattress main body shown in FIG. 2.
Figure 4:
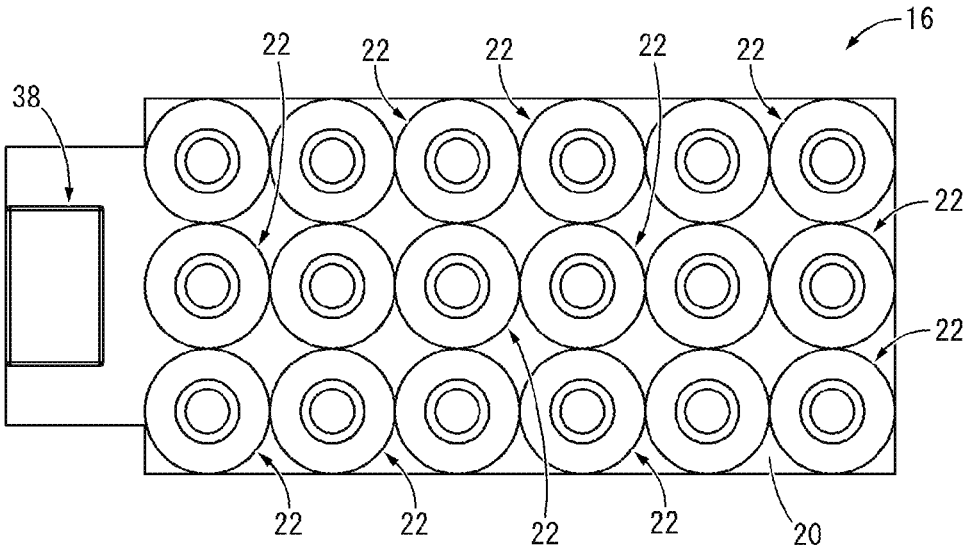
FIG. 4 is a top plan view of the cell unit shown in FIG. 3.
Figure 5:
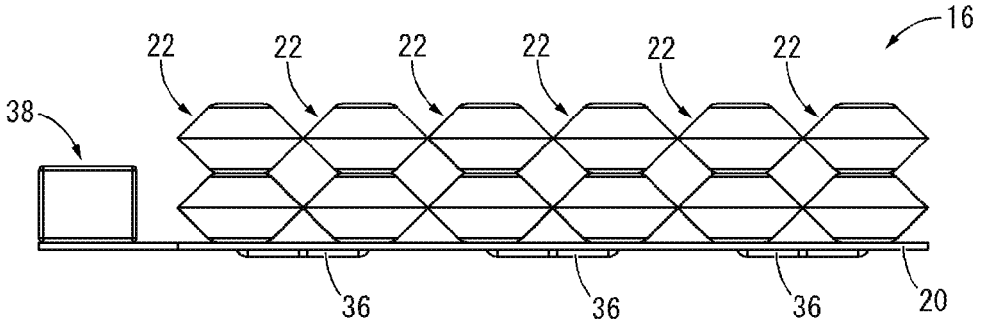
FIG. 5 is a front view of the cell unit shown in FIG. 3.

As shown in FIGS. 3 through 5, each cell unit 16 comprises a substrate 20 formed of polyurethane foam or the like having a plate shape or a sheet shape, and a plurality of cells 22 attached on the substrate 20. The cell unit 16 of the present embodiment includes eighteen cells 22 on the substrate 20 such that the cells 22 are arranged in three rows in the length direction of the bed and in six columns in the width direction of the bed.

Figure 6:
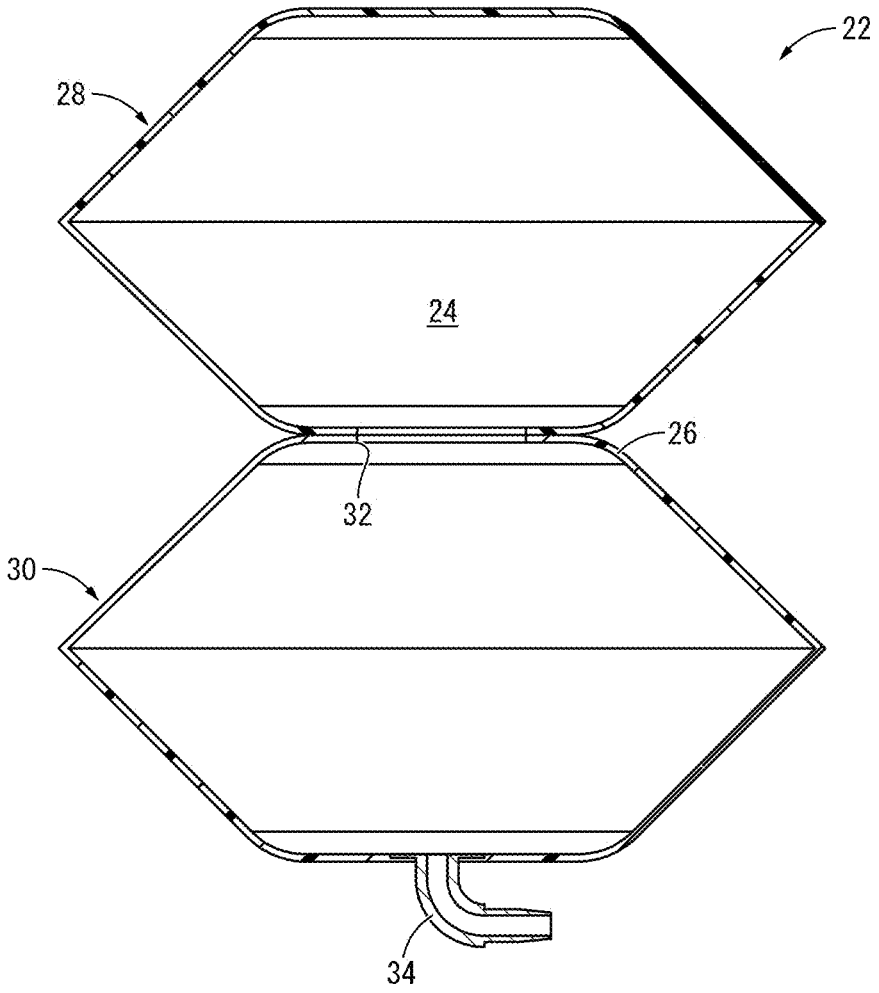
FIG. 6 is a vertical cross sectional view of a cell of the cell unit shown in FIG. 3.

Each cell 22, as shown in FIG. 6, has a hollow bag shape including a fluid chamber 24 inside thereof, and in the present embodiment, has an upper-lower two-stage structure that includes a constricted part 26 at its vertically medial portion whose transverse cross-sectional shape is made small. More specifically, the cell 22 includes an upper part 28 and a lower part 30 each having a hollow bag shape in which a top wall and a bottom wall of generally circular disk shape are integrally linked by peripheral walls. The cell 22 is formed by the bottom face of the upper part 28 and the top face of the lower part 30 being secured to each other by means of bonding, welding or the like. Each peripheral wall of the upper part 28 and the lower part 30 has tapered contours whose diameter dimension becomes smaller toward vertically both ends. By the diameter dimension (transverse cross section) being made small at the secured portion of the upper part 28 and the lower part 30, the constricted part 26 is provided at the vertically medial portion of the cell 22. Moreover, in the cell 22, the bottom wall of the upper part 28 and the top wall of the lower part 30, which are secured to each other, are each vertically perforated by a communication hole 32. However, the specific structure of the cell 22 is not limited in any particular way. For example, the cell 22 may have a structure including no constricted part 26 such as a hollow pillar shape, or may alternatively have a multiple-stage structure including three or more stages arranged vertically and constricted by a plurality of constricted parts 26 that are vertically remote to one another.

While no particular limitation is imposed, the upper part 28 and the lower part 30 of the cell 22 can be formed by, for example, two resin sheets being overlapped at their outer peripheral portions and secured to each other by bonding, welding or the like. However, it is also possible to obtain the cell 22 by means of subjecting synthetic resin material to vacuum forming or the like. Besides, while the forming material of the cell 22 is not limited in particular, it is desirable that the amount of extensional and contractive deformation of the material be small, as well as the material be soft. For example, synthetic resin materials such as polyethylene, polypropylene, polystyrene, polyamide, polycarbonate, polytetrafluoroethylene (PTFE), and polyurethane can be adopted.

Inside the cell 22, a fluid chamber 24 is formed by the internal space of the upper part 28 and the internal space of the lower part 30 being interconnected through the communication hole 32. Furthermore, an inlet/outlet port 34 is provided to the bottom wall of the lower part 30 of the cell 22. The inlet/outlet port 34 is a hollow tube formed integrally with or separately from the lower part 30 by using resin, metal or the like, and communicates with the fluid chamber 24. In the present embodiment, the inlet/outlet port 34 extends downward from the bottom wall of the cell 22 and bends to extend to the lateral side. Thus, vertical dimension of the inlet/outlet port 34 is made small and influence on the support structure is reduced. Moreover, conduit of pipelines 36 (described later) connected to the inlet/outlet port 34 is facilitated.

The cells 22 constructed in the above manner are arranged on the substrate 20. Specifically, as shown in FIG. 5, the cells 22 are arranged such that their bottom portions are overlapped with the upper face of the substrate 20 and fixed thereto by means of bonding or the like, and the inlet/outlet port 34 perforates the substrate 20 and projects downward. In the present embodiment, the cell unit 16 includes the cells 22 that are arranged in a plurality of rows in the length direction of the bed and in a plurality of columns in the width direction of the bed. In the cell unit 16, the cells 22 are arranged in three rows in the length direction of the bed and six columns in the width direction of the bed, and the inlet/outlet ports 34 of the cells 22, 22 adjacent to each other in the width direction of the bed are interconnected by the pipeline 36. In the present embodiment, similar inlet and outlet of a fluid such as air are performed with respect to the fluid chambers 24, 24 of the cells 22, 22 connected by the pipeline 36 so as to achieve simple structure and control. However, by providing a valve body to the pipeline 36, for example, it is also possible to individually allow inlet and outlet of the fluid with respect to the interconnected fluid chambers 24. The number of cells 22 and arrangement thereof in the cell unit 16 described in the present embodiment are merely exemplary, and shall not be limited in particular.

Besides, with regard to the cell unit 16 in the present embodiment, an inlet/outlet device 38 is disposed to the lateral side of the area where the cells 22 are arranged. The inlet/outlet device 38 is configured to supply and exhaust the fluid such as air with respect to the fluid chamber 24 of each cell 22 within the cell unit 16, and includes a pump and a valve (not shown) as well as a control device (not shown) for controlling operation of the pump and opening/closing of the valve. Then, the inlet/outlet device 38 is connected to each cell 22 by the pipelines 36 so as to communicate with the fluid chamber 24, and is capable of selectively supplying and exhausting the fluid such as air with respect to the fluid chamber 24 of each cell 22. By so doing, the amount of fluid within the cell 22 is adjusted, and with no load applied, namely, in the state in which the user's weight or the like is not acting, the inlet/outlet device 38 is configured to change the vertical height dimension of the cells 22. The inlet/outlet device 38 may be arranged to be remote from the cell unit 16. With this arrangement, the user is readily prevented from suffering from discomfort feeling due to the operating noise or the like of the pump or the valve. Moreover, the fluid to be supplied and exhausted with respect to the fluid chamber 24 by the inlet/outlet device 38 may be a gas such as air, or may be a liquid such as water.

Meanwhile, the division units 18*a* through 18*e* of the present embodiment have the roughly same size as that of the cell unit 16 both in the length and width directions of the bed, and are arranged in line in the length direction of the bed.

The division unit 18*a* includes a rectangular-plate-shaped or sheet-shaped substrate 40 having the roughly same planar shape as the arrangement area of the cells 22 of the cell unit 16. On the substrate 40, there is placed a generally rectangular-block-shaped cushion body 42 formed of a soft material such as polyurethane foam (urethane foam) and having the roughly same planar shape as that of the substrate 40. In the present embodiment, the division units 18*c*, 18*d* have the roughly same structure as that of the division unit 18*a*.

The division unit 18*b* has the roughly same structure as that of the cell unit 16, which comprises the substrate 20 and a plurality of the cells 22 arranged thereon. Besides, the division unit 18*b* includes the inlet/outlet device 38 to its lateral side that is connected to the fluid chamber 24 of each cell 22 by the pipelines 36. The division unit 18*b* of the present embodiment, the same as the cell unit 16, includes eighteen cells 22 such that the cells 22 are arranged in three rows in the length direction of the bed and in six columns in the width direction of the bed.

The division unit 18*e* comprises the substrate 40 and a cushion body 44, which is formed of a soft material such as polyurethane foam, arranged thereon. The cushion body 44 has a structure in which its lower part has a generally rectangular block shape, and a multitude of protrusions having a generally conical shape project upward therefrom. With this configuration, the structure of the division unit 18*e* is soft so as to readily deform at least at its upper part in comparison with the division units 18*a*, 18*c*, 18*d* that are formed of similar polyurethane foam or the like.

The cell units 16*a*, 16*b* and the division units 18*a* through 18*e* of the above constructions are attached to a base 46. The base 46 has a groove shape overall that extends in the length direction of the bed, and includes a bottom wall 48 having a generally flat plate shape and side walls 50, 50 provided at the ends in the width direction of the bed.

The bottom wall 48 has a thin plate shape of a planar shape corresponding to the upper face of the bed 11, and is a component formed of closed-cell polyurethane foam or the like that is, relatively, less likely to deform.

The side walls 50, 50 are formed of material similar to the bottom wall 48 and have a solid rectangular block shape or a hollow rectangular box shape, and are provided to the both ends of the bottom wall 48 in the width direction of the bed while projecting above the bottom wall 48. By so doing, the base 46 constituted by the bottom wall 48 and the side walls 50, 50 is provided with a unit disposition recess 52 that extends in the length direction of the bed while opening upward. Furthermore, to the upper face of each side wall 50, a buffer body 54 is attached. The buffer body 54 is a component formed of open-cell polyurethane foam or the like and is softer than the side wall 50. The buffer body 54 has, for example, a rectangular plate shape and covers the upper face of the side wall 50.

Moreover, the base 46 is divided at the medial portion in the length direction of the bed, and the portion of division is the position corresponding to a folding part 62 of the bed 11. The divided two portions are tiltable relative to each other.

In the unit disposition recess 52 of the base 46, the cell units 16*a*, 16*b* and the division units 18*a* through 18*e* are disposed. More specifically, the cell units 16*a*, 16*b* and the division units 18*a* through 18*e* are disposed in line in the length direction of the bed, and the order of arrangement is, from the head part side in the length direction of the bed, division unit 18*a*, division unit 18*b*, cell unit 16*a*, cell unit 16*b*, division unit 18*c*, division unit 18*d*, and division unit 18*e* (see FIGS. 1 and 2). In this way, the present embodiment has a unit structure that is divided not only at the boundary of the cell units 16*a*, 16*b* corresponding to the folding part 62 of the bed 11 but also at a location away from the folding part 62 of the bed 11 in the length direction of the bed. Accordingly, the five division units 18*a* through 18*e* that are distinct from the cell units 16*a*, 16*b* are disposed. Meanwhile, the base 46 is divided only at a portion in the length direction of the bed that corresponds to the folding part 62 of the bed 11. The division unit 18*a*, the division unit 18*b*, and the cell unit 16*a* are positioned with respect to one another by the head part side of the base 46, while the cell unit 16*b*, the division unit 18*c*, the division unit 18*d*, and the division unit 18*e* are positioned with respect to one another by the leg part side of the base 46. Besides, in the present embodiment, none of the cell units 16*a*, 16*b* and the division units 18*a* through 18*e* are divided in the width direction of the bed. They are continuous entirely over the unit disposition recess 52 in the width direction of the bed. Furthermore, each inlet/outlet device 38 of the cell units 16*a*, 16*b* and the division unit 18*b* is housed in a space provided in the side wall 50 of the base 46. No particular limitation is imposed as to the specific structures, arrangement or combination of the division units 18*a* through 18*e*. Also, it is not necessary that the number of the division units is five.

The cell unit 16*a* and the cell unit 16*b* are arranged so as to be adjacent to each other in the length direction of the bed with the portion of division of the base 46 interposed therebetween. Accordingly, the substrates 20, 20 of the cell units 16*a*, 16*b* are adjacent at the portion of division of the base 46, and are tiltable relative to each other at the portion of division (boundary) of the substrates 20, 20. Here, a connecting body 56 is attached to the cells 22 that are adjacent to the portion of division of the substrates 20, 20 of the cell unit 16*a* and the cell unit 16*b*.

Figure 7:
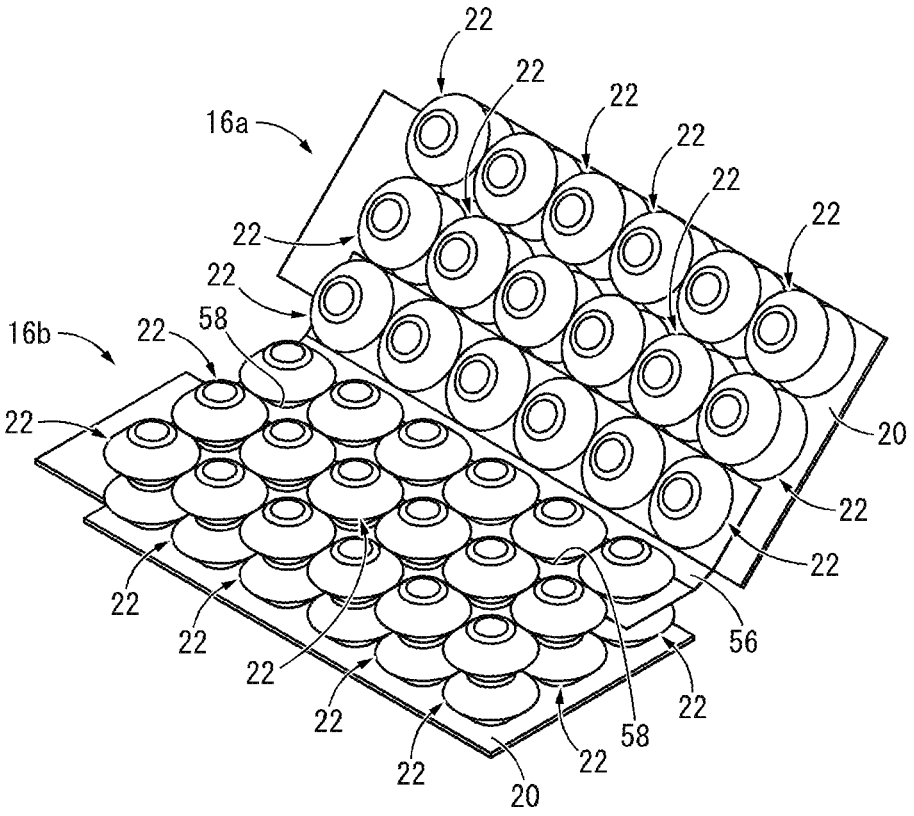
FIG. 7 is a perspective view showing the cell units of FIG. 3 that are adjacent to each other with a folding part interposed therebetween in a state of back raising.
Figure 8:
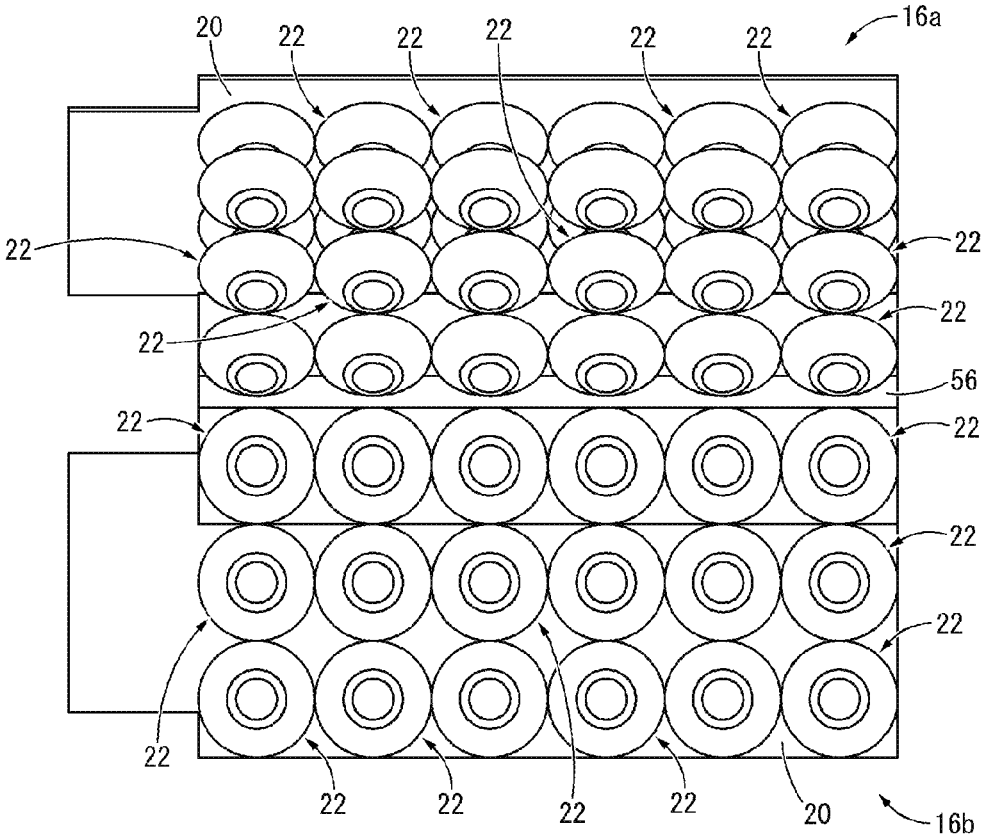
FIG. 8 is a top plan view showing the cell units of FIG. 3 that are adjacent to each other with the folding part interposed therebetween in the state of back raising.
Figure 9:
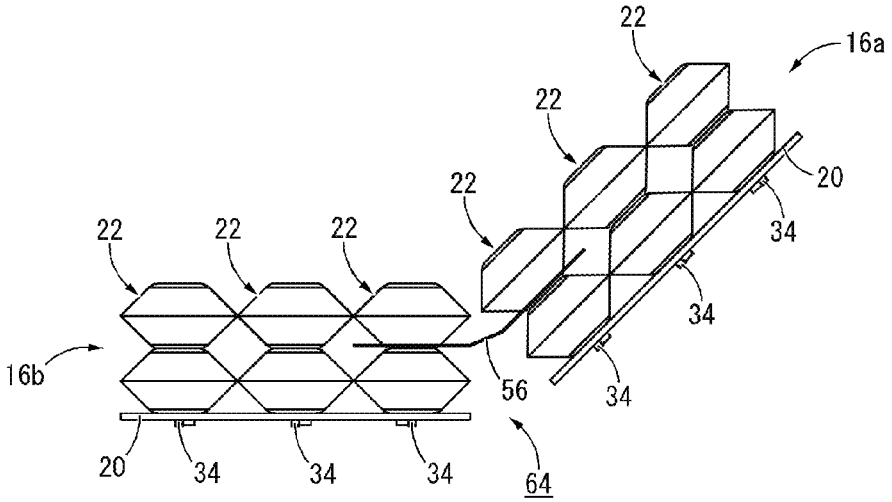
FIG. 9 is a right side view showing the cell units of FIG. 3 that are adjacent to each other with the folding part interposed therebetween in the state of back raising.

The connecting body 56 is a soft, flexible sheet, and is arranged so as to straddle the cell unit 16*a* and the cell unit 16*b* that are adjacent in the length direction of the bed, as depicted in FIGS. 7 through 9. A plurality of cell attachment holes 58 perforate the connecting body 56, and the cell attachment holes 58 have a circular cross section that corresponds to the constricted part 26 of the cell 22. With regard to the connecting body 56 of the present embodiment, twelve cell attachment holes 58 are arranged in two rows in the length direction of the bed and six columns in the width direction of the bed. The hole shape of the cell attachment hole 58 is not limited in particular, and may also be a hole having, for example, a polygonal cross section or an irregular-shaped cross section according to the transverse cross section of the cell 22.

No particular limitation is imposed as to the forming material of the connecting body 56. For example, a synthetic resin such as polyethylene, polypropylene, polystyrene, polyamide, polycarbonate, and polytetrafluoroethylene (PTFE), or an elastomer such as soft non-foaming polyurethane and silicone rubber may be preferably adopted. The connecting body 56 of the present embodiment is formed of non-foaming polyurethane. In the present embodiment, the phrase "the connecting body 56 has flexibility" means that, for example, the connecting body 56 has such softness as to undergo bending (flexural) deformation with respect to action of the weight of a typical user, and that resistance to the action of the user's weight due to its rigidity is sufficiently small.

Moreover, it is desirable that the connecting body 56 have a certain degree of extension and contraction properties. This makes it possible to permit deformation of the cells 22 to be described later owing to extensional and contractive deformation of the connecting body 56. In the present embodiment, the phrase "the connecting body 56 has extension and contraction properties" means that the extension and contraction ratio of the connecting body 56 (a percentage of the dimension after extensional deformation with respect to the dimension before extensional deformation) is greater than 100%, and that relative displacement of the adjacent cells 22, 22 that are attached to the same connecting body 56 is permitted by elastic deformation of the connecting body 56.

However, if the permitted amount of extensional deformation of the connecting body 56 is excessively large, the function that limits deformation of the cells 22 may be insufficient. Thus, it is desirable that the permitted amount of extensional deformation of the connecting body 56 be lowered to such an extent as to permit deformation required by the cells 22. Specifically, the permitted amount of extensional deformation of the connecting body 56 is preferably set such that the gap between the adjacent cells 22, 22 that are adjacent at the portion of division of the mattress 10 is limited to 70 mm or less. By so doing, the user will be effectively prevented from getting caught between the cells 22, 22. This amount of extensional deformation for which the connecting body 56 is permitted is set in the aforementioned preferable range by, for example, setting a tensile modulus of elasticity or a thickness of the connecting body 56 depending on the force that acts between the adjacent cells 22, 22 in the direction of mutually separating them. That is, according to "Makiko Kouchi and Masaaki Mochimaru, 2005: AIST Anthropometric Database, National Institute of Advanced Industrial Science and Technology, H16PRO 287", among the sites of a human body that can get caught between the cells 22, 22, the site having the smallest dimension is the scye depth (the distance between the anterior axilla point and the posterior axilla point) that can get caught therebetween in the state of lateral position. In particular, 71 mm, which is the minimum value of the scye depth of an elderly female, is the minimum dimension of the human body sites that are assumed to get caught between the adjacent cells 22, 22. Therefore, by setting the permitted amount of extensional deformation of the connecting body 56 such that the gap between the adjacent cells 22, 22 is limited to 70 mm or less, it is possible to prevent the user from getting caught between the adjacent cells 22, 22. On the assumption that the mattress 10 is used by a care receiver, in addition to the case in which the care receiver, namely the user, gets caught between the adjacent cells 22, 22, also anticipated is the case in which a caregiver gets caught therebetween when kneeling down or putting his/her hands on the mattress 10. However, with respect to an adult female who is supposed to be a caregiver, the minimum dimension of the breadth of the knee, which is likely to get caught, is 87 mm. Thus, by setting the permitted amount of extensional deformation of the connecting body 56 such that the gap between the adjacent cells 22, 22 is limited to 70 mm or less, the caregiver can also be prevented from getting caught.

Figure 10A:
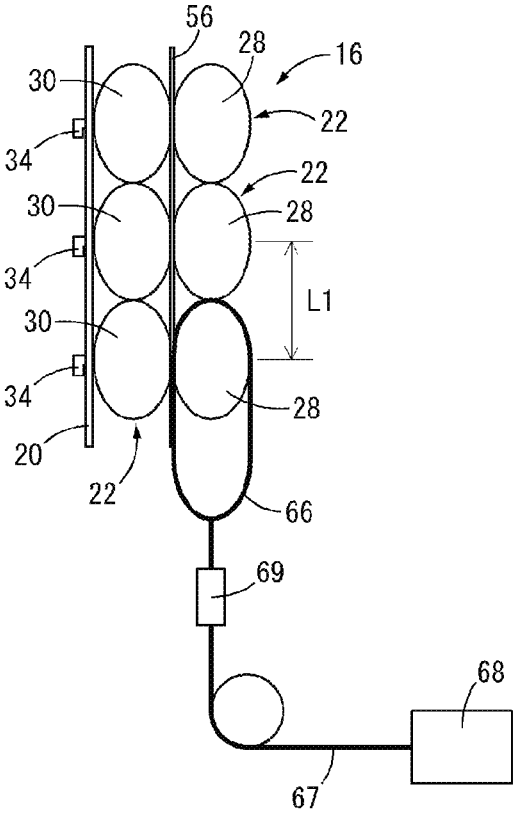
FIGS. 10A and 10B are views suitable for explaining an evaluation method of an extension and contraction ratio of a connecting body, wherein FIG. 10A indicates a state before a load input, and FIG. 10B indicates a state after the load input.
Figure 10B:
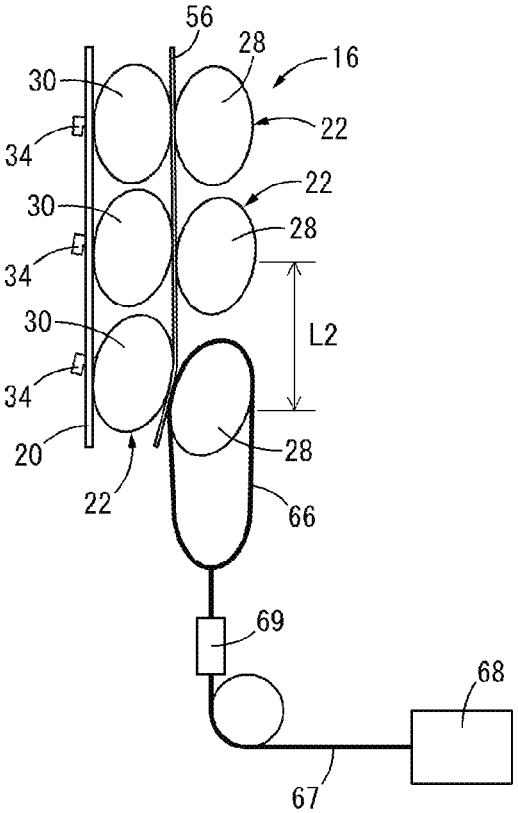
Figure 11:
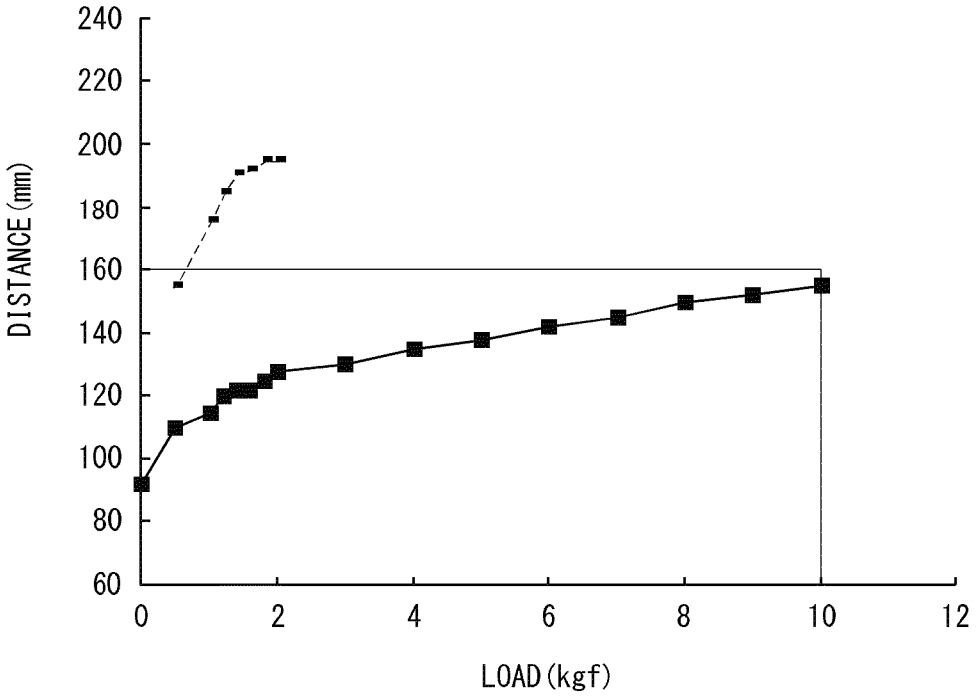
FIG. 11 is a graph showing results measured by means of the evaluation method of FIGS. 10A and 10B.

It is possible to confirm that the permitted amount of extensional deformation (extension and contraction ratio) of the connecting body 56 described above is set in the aforementioned preferable range by means of the following evaluation method, for example. Specifically, as depicted in FIGS. 10A and 10B, prepared is the cell unit 16 for evaluation in which the connecting body 56 for evaluation is attached to all the cells 22, and the substrate 20 thereof is supported in the roughly vertical direction. An annular tension belt 66 that generally does not extend or contract is attached to the upper part 28 of the cell 22 arranged at the lower end. Besides, a force transmission part 67 such as a cord or wire that generally does not extend or contract is linked to the lower end portion of the tension belt 66, and the force transmission part 67 is allowed to be wound by a winding device 68. By winding the force transmission part 67 with the winding device 68, a downward load is configured to exert on the tension belt 66. Moreover, on the path of the force transmission part 67, there is provided a measuring device 69 such as a spring balance that is able to measure a tensile force acting on the force transmission part 67. With regard to the cell unit 16 for evaluation, in the stationary state, the gap between the cells 22, 22 that are adjacent in the vertical direction is approximately 0, and the distance L1 between the centers thereof is 90 mm. Furthermore, the diameter of the cell attachment hole 58 of the connecting body 56 is made roughly equal to the outside diameter of the constricted part 26 of the cell 22, which are both 35 mm here. By winding the force transmission part 67 with the winding device 68, a downward load of 10 kgf (the maximum input load in the planar direction which is assumed to act on the cell 22 when the mattress 10 is commonly used) is exerted on the tension belt 66. With such a load exerted, the distance L2 between the center of the cell 22 positioned at the lower end and the center of the adjacent cell 22 positioned above the said cell 22 is measured. As depicted in the solid line in FIG. 11, when L2 is 160 mm or less, the permitted amount of extensional deformation of the connecting body 56 is evaluated to be appropriate.

According to the results in which a structure without the connecting body 56 was similarly evaluated (as indicated in the dashed line in FIG. 11), the distance between the centers of the adjacent cells 22, 22 exceeded 160 mm due to input of a small load, which may lead to a problem of getting caught of the user between the adjacent cells 22, 22. Thus, it was found desirable to provide the connecting body 56 and limit the distance between the centers of the adjacent cells 22, 22. Here, the maximum input load in the planar direction assumed in the above evaluation is supposed to be a load that is input in the cells 22, 22 arranged at the adjacent ends of the cell units 16*a*, 16*b* due to the back raising, which will be described later. Accordingly, as shown in the present embodiment, in some cases, the mutual connection by means of the connecting body 56 is not required between the plurality of cells 22 that constitute the same cell unit 16.

Then, twelve cells 22 that are adjacent to each other with the portion of division of the base 46 interposed therebetween are individually inserted through the twelve cell attachment hole 58 provided to the connecting body 56, so that the connecting body 56 is attached to the twelve cells 22 in a non-adhesive way, and supported by the twelve cells 22. By so doing, the connecting body 56 is disposed between the cell units 16*a*, 16*b* so as to straddle the portion of division of the cell units 16*a*, 16*b*. In the present embodiment, the connecting body 56 is externally attached to the constricted parts 26 of the cells 22, and is supported by the lower parts 30 of the cells 22 so as to be upwardly remote from the substrate 20. During insertion operation of the cell 22 through the cell attachment hole 58 of the connecting body 56, by decreasing the amount of air within the fluid chamber 24 of the cell 22 so as to permit a large amount of deformation of the cell 22, the operation becomes easy. After insertion of the constricted part 26 of the cell 22 through the cell attachment hole 58, by supplying the air to the fluid chamber 24, the cell 22 is prevented from slipping out of the cell attachment hole 58.

Whereas a single connecting body 56 is disposed at the vertically medial portion of the cell 22 in the present embodiment, a plurality of connecting bodies 56 may be provided, for example. In particular, with respect to the cell 22 including a plurality of constricted parts 26, the connecting bodies 56 can be separately attached to all of or some of the constricted parts 26. Moreover, it is also possible to overlap a plurality of connecting bodies 56 and attach them to a certain vertical portion of the cell 22, thereby enhancing load bearing capability and the like.

The mattress 10 is constituted by the lid body 14 being attached to the mattress main body 12 of the above structure. The lid body 14 is a soft component made of polyurethane foam or the like, and in the present embodiment, has a rectangular open-box shape that opens downward. The lid body 14 is superposed and attached to the upper part of the mattress main body 12, so as to cover the upper faces of the cell units 16 and the division units 18*a* through 18*e*.

Figure 12:
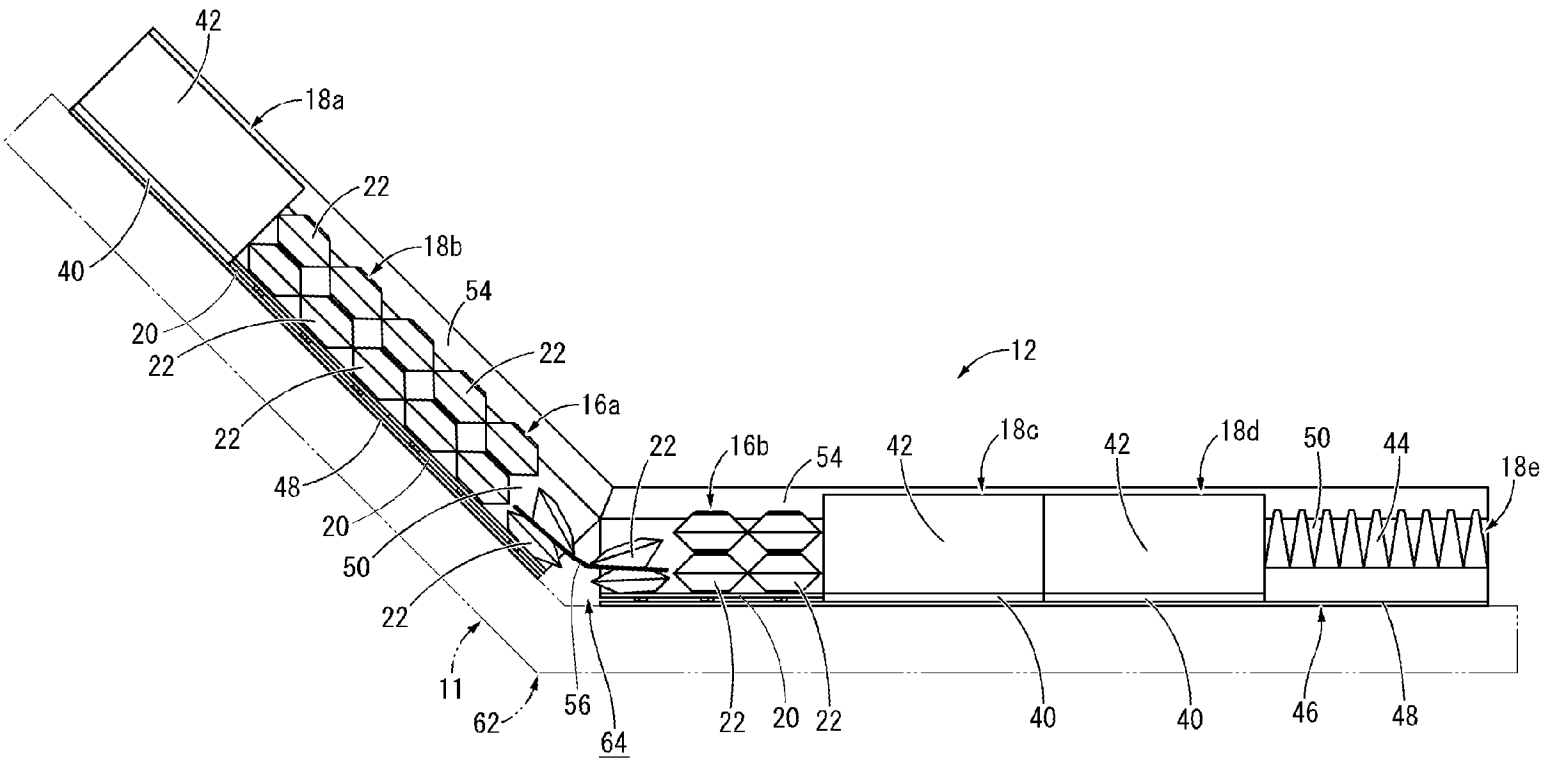
FIG. 12 is a side transparent view showing the mattress shown in FIG. 1 in the state of back raising.

As shown in FIGS. 1 and 12, the mattress 10 constructed in the above manner is laid on the upper face of the bed 11 and configured to support the user with its upper face. In the mattress 10 of the present embodiment, the division unit 18*b* and the cell units 16*a*, 16*b* using the cells 22 are adopted in the region that supports the user from the shoulder to the thigh on which the user's weight concentratedly acts in the supine position, so as to be able to obtain effect of preventing bedsores and the like owing to effective body pressure dispersion. In the cell units 16*a*, 16*b*, the support load of the user that acts on the upper face of the lid body 14 is configured to be transmitted to the substrate 20 via the cells 22, so that the user will be indirectly supported by the substrate 20. In the present embodiment, in the division unit 18*b* as well, the load acted on the division unit 18*b* by the user is configured to be indirectly supported by the substrate 40 in a similar way. On the other hand, in the regions that support the head part and the leg part from the knee to the ankle for which the body pressure that acts on the user is small, adopted are the division units 18*a*, 18*c*, 18*d* that include the cushion body 42 of simple structure, so as to simplify the structure and the control. Meanwhile, in the region that supports the user's foot, adopted is the division unit 18*e* including the cushion body 44 that is softer than the division units 18*a*, 18*c*, 18*d* owing to its shape without using the cells 22, so as to realize body pressure dispersion with a simple structure.

With respect to the bed 11, the folding part 62 is provided at the medial portion in the length direction, and with the folding part 62 interposed, one side is tiltable relative to the other side. Specifically, as shown in FIG. 12, the bed 11 is provided with a back-raising mechanism in which the portion that supports the user's upper body tilts relative to the portion that supports the user's lower body and raises the upper body of the user who is lying on the bed 11. While no particular limitation is imposed as to the specific structure of the back-raising mechanism of the bed 11 provided that it realizes the back raising by means of tilting as described above, preferably adopted are, for example, the one that is operated by hydraulic or air pressure, the one that is operated by the output of an electric motor, or the like.

Regarding the back-raising mechanism of the bed 11, the mattress 10 has a structure of being divided at the location corresponding to the folding part 62 of the bed 11. Accordingly, with the portion of division interposed, the upper body side of the mattress 10 tilts relative to the lower body side thereof in a roughly independent manner, so as to readily follow the back raising of the bed 11. Moreover, the mattress 10 is prevented from being bent by the folding part 62 of the bed 11 with an excessive deformation. Thus, even if the back raising of the bed 11 is repeated, sufficient durability will be obtained. With respect to the word "divided," it is acceptable as long as the substrates 20, 20 of the cell units 16*a*, 16*b* are not integrally structured in order to permit relative movement such as a bend of the upper body side and the lower body side at the time of back raising. For example, the substrates 20, 20 may be linked to each other by a linking component having flexibility or elasticity that can permit relative movement of the substrates 20, 20. Besides, it is sufficient as long as the substrates 20, 20 are divided so as to be relatively movable. Thus, the pipeline 36, the inlet/outlet device 38 and the like for supplying and exhausting pressurized fluid with respect to the cells 22 attached to the substrates 20, 20 do not need to be provided independently to each divided substrate 20.

In the present embodiment, the cell unit 16 is equipped with the inlet/outlet device 38 on the lateral side of the arrangement area of the cell 22, and the pipeline 36 that connects the cells 22 and the inlet/outlet device 38 is arranged so as to be housed below each substrate 20 in plan view without straddling the portion of division of a pair of the cell units 16*a*, 16*b*. Therefore, in the pipeline 36 that communicates with the fluid chamber 24 of the cell 22, the repeated bends at the folding part 62 of the bed 11 will not cause deterioration in durability, unexpected cutoff, or the like.

Also, at the portion of division of the mattress 10 corresponding to the folding part 62 of the bed 11, the connecting body 56 is disposed so as to straddle the six pairs of cells 22 that are adjacent to each other with the portion of division interposed therebetween, so that the amount of deformation of the cells 22 is limited by the connecting body 56. Specifically, when the bed 11 is back-raised, as shown in FIG. 12, with respect to the cells 22 arranged on the opposite sides with the folding part 62 interposed therebetween, the upper parts 28 tilt to the folding part 62 side in a wobble manner due to action of the user's weight. In this respect, the tilted upper part 28 of the cell 22 comes into contact with the connecting body 56 so that the amount of tilting deformation thereof is limited, and the upper part 28 is prevented from an excessive tilt. By so doing, it is possible to prevent the user's buttocks or the like from getting caught between the cells 22 of the cell units 16*a*, 16*b* at the folding part 62, thereby stably supporting the user's body.

Moreover, since the cells 22 arranged on the opposite sides with the folding part 62 interposed therebetween are connected by the connecting body 56, the load exerted on a specific cell 22 will be exerted to the other cells 22 via the connecting body 56, so as to disperse the input. This makes it possible to avoid the situation in which only a specific cell 22 significantly deforms, thereby stabilizing the support surface (the upper face of the mattress 10).

Furthermore, in the case in which the cells 22, which are adjacent to each other with the portion of division corresponding to the folding part 62 interposed therebetween, tilt to the side opposite to the folding part 62 due to action of an external load, the connecting body 56 limits the amount of displacement of the cells 22 away from the folding part 62. By so doing, it is possible to limit or avoid generation of the gap between the cells 22 arranged with the folding part 62 interposed therebetween.

In the present embodiment, the cells 22, which are adjacent to each other with the portion of division corresponding to the folding part 62 interposed therebetween, are positioned with respect to each other by the connecting body 56 to some extent in the width direction of the bed as well. Thus, generation of a large gap between the cells 22 will be prevented in the width direction of the bed as well, thereby stably retaining the support surface. This will realize excellent comfort of sleeping, prevention of bedsores owing to stabilization of body pressure dispersion effect, and the like. In this way, the connecting body 56 of the present embodiment relatively positions a part of the cells 22 within each cell unit 16 and limits the amount of relative displacement of the cells 22. Thus, the connecting body 56 also functions as a displacement limiting member.

Meanwhile, at the time of back raising of the bed 11, the tilting center of the mattress 10 is remote upward from the upper face of the bed 11. Thus, in the mattress 10, a gap 64 that becomes larger toward the bed 11 side is formed between the cell units 16*a*, 16*b* where the mattress 10 is divided. Accordingly, by the user's buttocks or the like getting caught in the gap 64, there may be a risk of causing bottoming out of the user between the adjacent cells 22. However, owing to the connecting body 56 that is supported by the vertically medial portion of the cell 22, even if the user gets caught in the gap 64 between the cell units 16*a*, 16*b*, the user can be received by the connecting body 56, thereby avoiding occurrence of bottoming out, namely contact of the user with the hard bed 11.

Furthermore, since the connecting body 56 is attached to the vertically medial portion of the cell 22, the connecting body 56 is supported so as to be remote upward from the substrate 20, thereby excellently exhibiting prevention effect of bottoming out owing to the connecting body 56. Moreover, in the present embodiment, the vertical position of the connecting body 56 is configured to change due to the change in height of the cell 22. Thus, it is possible to excellently obtain body pressure dispersion effect through inlet and outlet of the fluid within the fluid chamber 24 of the cell 22 while preventing occurrence of bottoming out at the folding part 62.

In particular, the connecting body 56 is formed of a flexible sheet. Therefore, the user will be softly received by the connecting body 56, without causing any problem of pain or sense of discomfort due to contact with the connecting body 56. Besides, the connecting body 56 is elastically supported by the lower part 30 of the cell 22. Thus, the user will be softly received by the connecting body 56 in an advantageous way by means of not only flexure or extensional and contractive deformation of the connecting body 56 itself, but also elastic deformation of the cells 22. It is desirable for the connecting body 56 to be permitted a certain degree of extensional and contractive deformation, in order to softly receive the user. In this respect, the permitted amount of extensional and contractive deformation of the connecting body 56 is set to such an extent that bottoming out caused by deformation of the connecting body 56 cannot occur, in consideration of the height of the lower part 30 of the cell 22, the interval between the cells 22 that are adjacent to the folding part 62, and the like.

Figure 13:
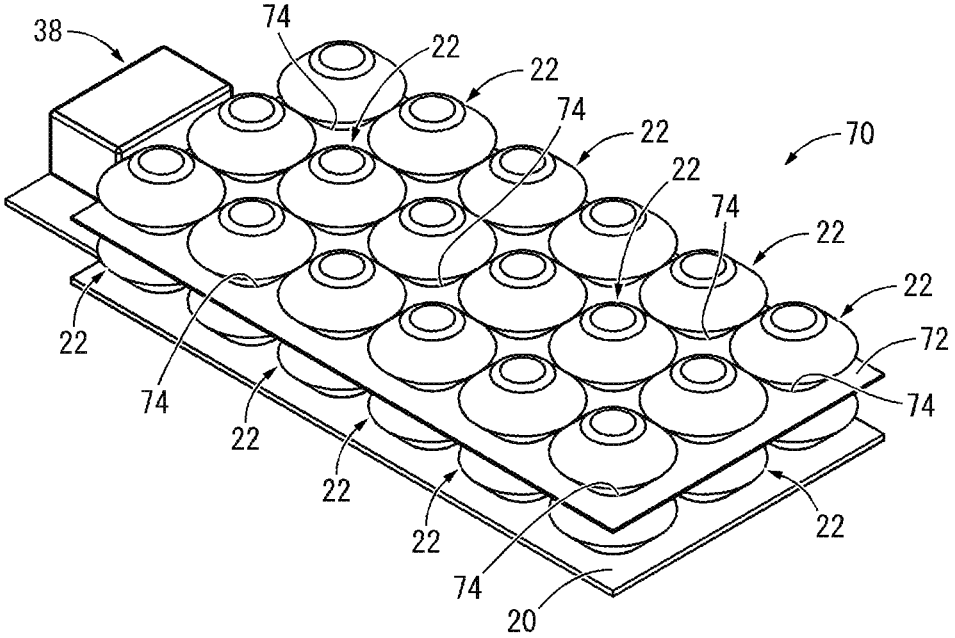
FIG. 13 is a perspective view of a cell unit constituting a mattress according to a second embodiment of the present invention.
Figure 14:
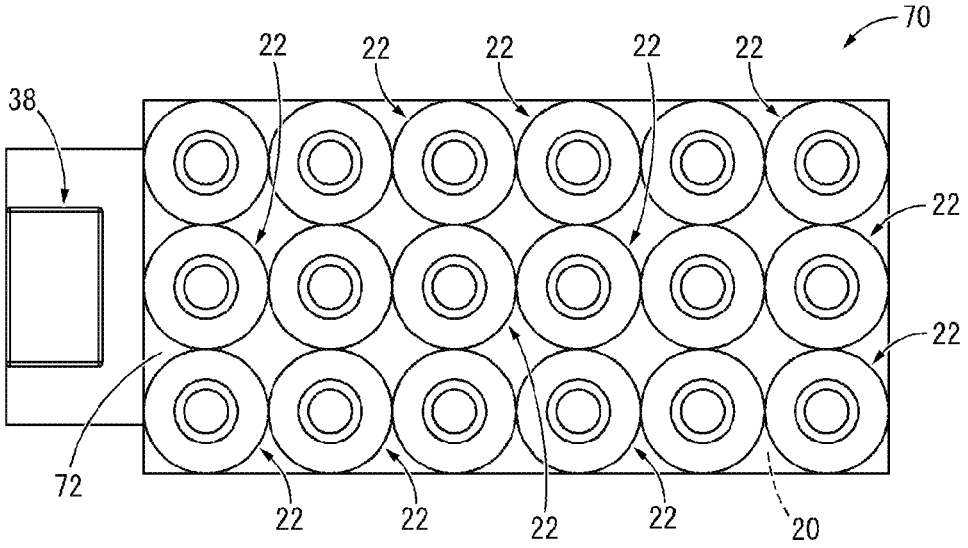
FIG. 14 is a top plan view of the cell unit shown in FIG. 13.
Figure 15:
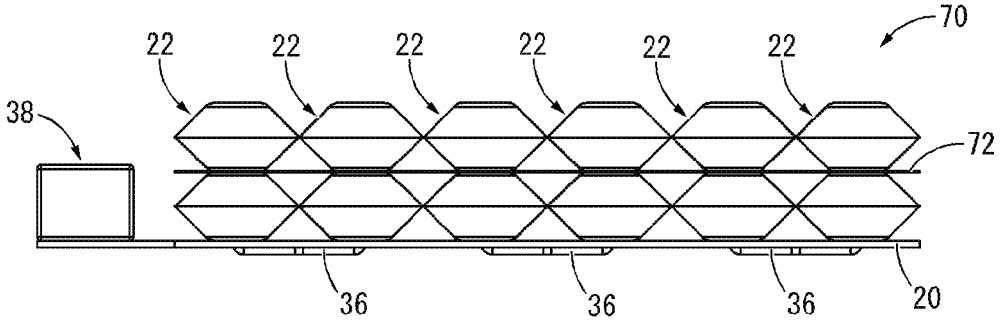
FIG. 15 is a front view of the cell unit shown in FIG. 13.

FIGS. 13 through 15 depict a cell unit 70 that constitutes a mattress according to a second embodiment of the present invention. The cell unit 70 has a structure in which a displacement limiting member 72 is provided to the cell unit 16 shown in the first embodiment. In the following description, components and parts that are substantially identical with those in the first embodiment will be assigned like symbols and not described in any detail. Also, with respect to the portions that are not shown in the drawings (namely, the division units 18*a* through 18*e*, the base 46, the lid body 14, and the like), the same structure as that of the first embodiment can be adopted.

Described more specifically, the displacement limiting member 72 is a component that positions eighteen cells 22 within the cell unit 70 with respect to one another and limits the amount of relative displacement of the cells 22. In the present embodiment, the displacement limiting member 72 has a structure in which a flexible sheet includes eighteen insertion holes 74 that are arranged in three rows and in six columns. The eighteen cells 22 are inserted into the respective insertion holes 74 and the displacement limiting member 72 is externally attached to the constricted parts 26 of the cells 22, so that the displacement limiting member 72 is arranged above the substrate 20 and supported by the vertically medial portion of the cells 22. With this configuration, the cells 22 that constitute the cell unit 70 are positioned in the axis-perpendicular direction by the displacement limiting member 72, and the intervals between the cells 22 are moderately regulated. In the present embodiment, the diameter of the insertion hole 74 of the displacement limiting member 72 is made larger than the outside diameter dimension of the constricted part 26 of the cell 22. Thus, the amount of relative displacement of the plurality of cells 22 that are connected by the displacement limiting member 72 is limited while being permitted to some extent.

Whereas the displacement limiting member 72 may be a rigid component whose deformation is limited, it is desirable that the displacement limiting member 72 be a soft component having flexibility. In the present embodiment, the displacement limiting member 72 comprises a polymer sheet made of material similar to the connecting body 56 of the first embodiment. Besides, while it is desirable for the displacement limiting member 72 to be permitted a small amount of extensional and contractive deformation in order to effectively limit relative displacement of the cells 22, in the present embodiment, the displacement limiting member 72 has elastic extension and contraction properties. Accordingly, the relative displacement of the cells 22 is moderately limited, thereby permitting dimensional errors, accelerating body pressure dispersion owing to the displacement of the cells 22, and the like. In this case, it would also be acceptable that the insertion hole 74 of the displacement limiting member 72 has roughly the same dimension as the outside diameter dimension of the constricted part 26 of the cell 22, and relative displacement of the cells 22 is permitted owing to elastic deformation of the displacement limiting member 72. The permitted amount of elastic extensional deformation of the displacement limiting member 72 is set in a similar way to the permitted amount of extensional deformation of the connecting body 56, and can be evaluated by the same method as that for the connecting body 56.

Moreover, while in the present embodiment, a single displacement limiting member 72 is attached to the vertically medial portion of the cell 22 within the cell unit 70, for example, a plurality of displacement limiting members 72 may also be attached to the cell 22. In the case in which the plurality of displacement limiting members 72 are provided in this way, the displacement limiting members 72 may be arranged so as to be vertically remote from each other, or may be arranged so as to be vertically overlapped in a state of contact. Besides, the cells 22 whose displacement is limited may be different for each displacement limiting member 72. Namely, in addition to the case in which the displacement limiting member 72 is attached to all of the cells 22 within the cell unit 70 as in the present embodiment, there can be the case in which the displacement limiting member 72 is attached to some of the cells 22 selected therefrom.

Figure 16:
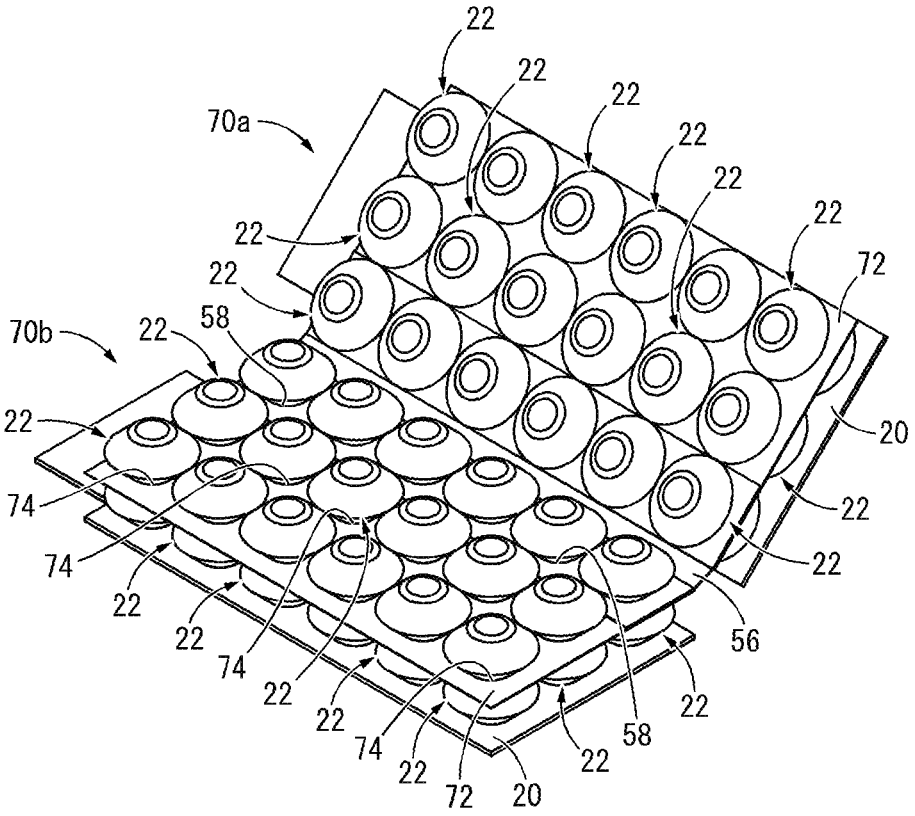
FIG. 16 is a perspective view showing the cell units of FIG. 13 that are adjacent to each other with a folding part interposed therebetween in a state of back raising.
Figure 17:
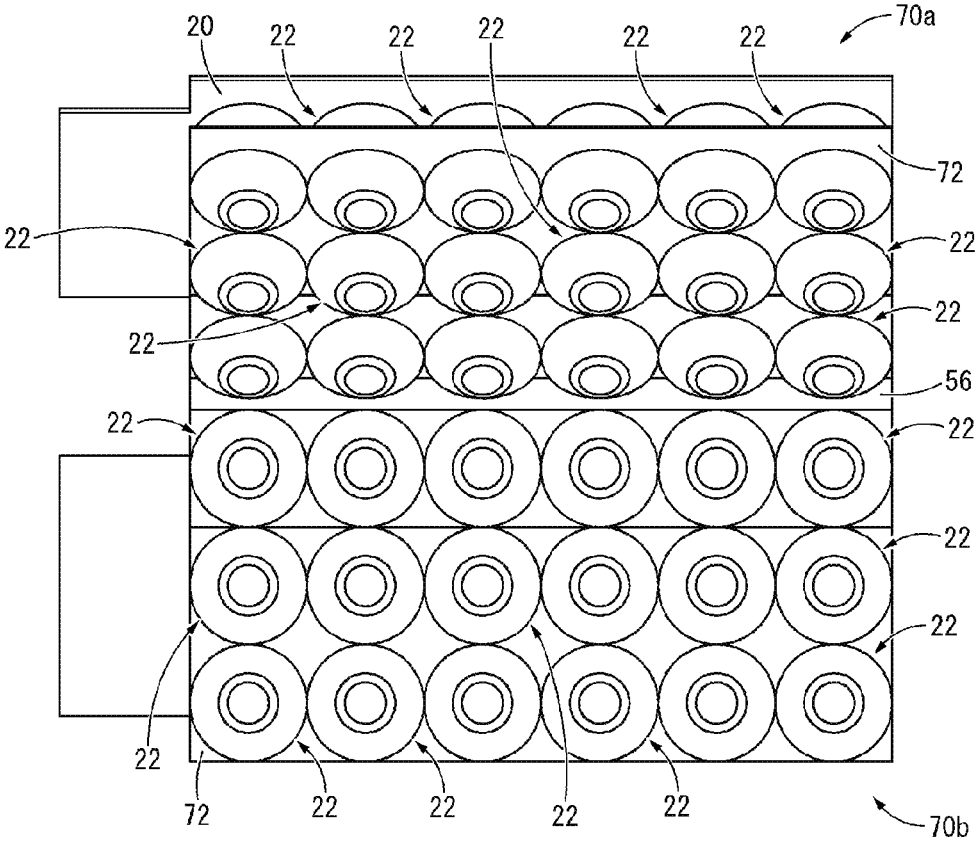
FIG. 17 is a top plan view showing the cell units of FIG. 13 that are adjacent to each other with the folding part interposed therebetween in the state of back raising.
Figure 18:
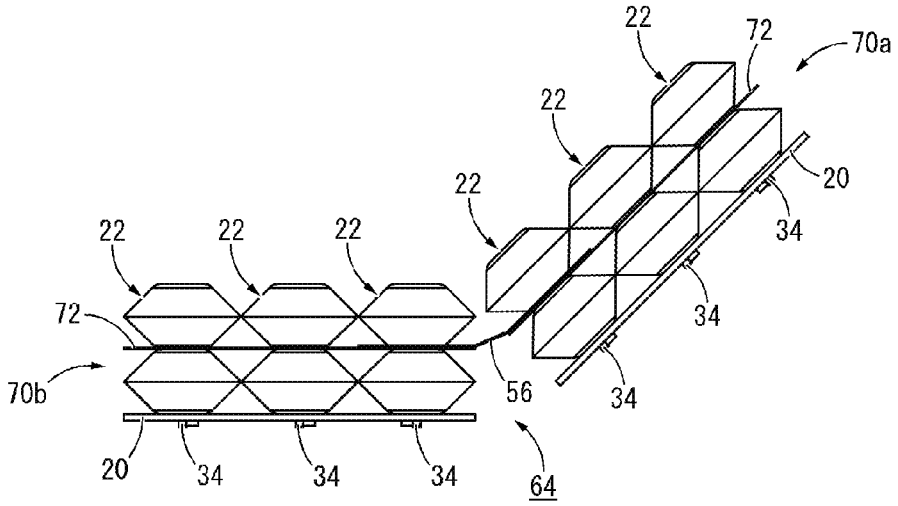
FIG. 18 is a right side view showing the cell units of FIG. 13 that are adjacent to each other with the folding part interposed therebetween in the state of back raising.
Figure 19:
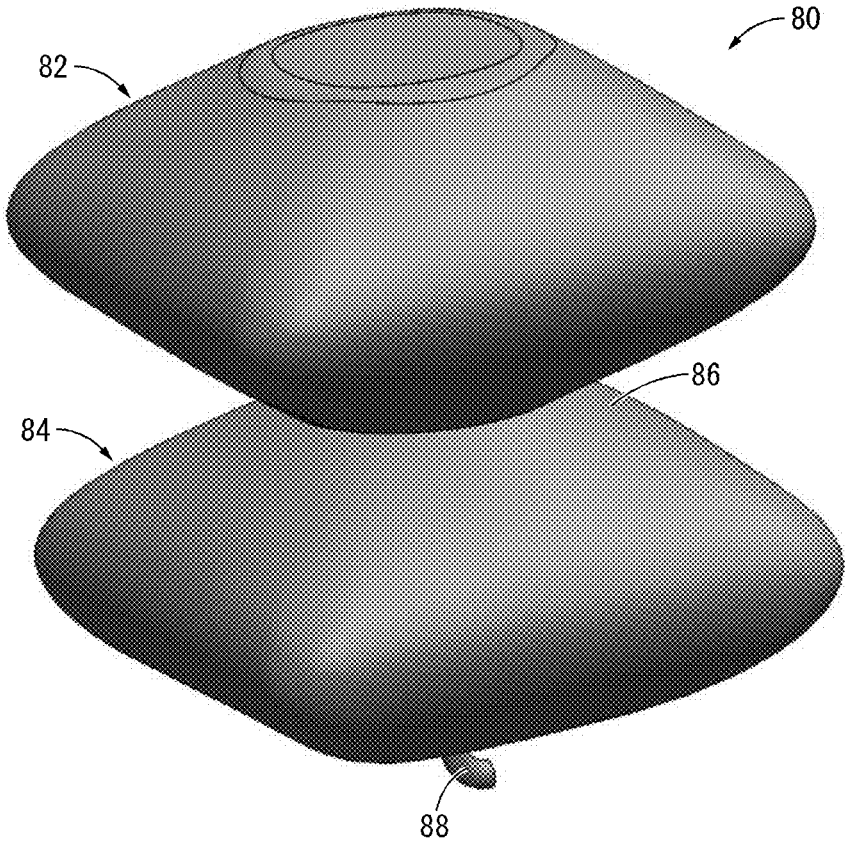
FIG. 19 is a perspective view of a cell constituting a mattress according to another mode of the present invention.
Figure 20:
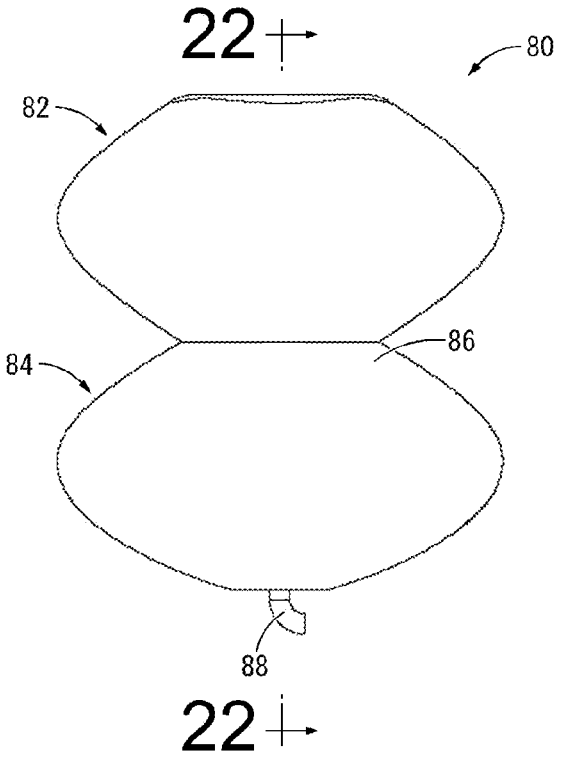
FIG. 20 is a front view of the cell shown in FIG. 19.
Figure 21:
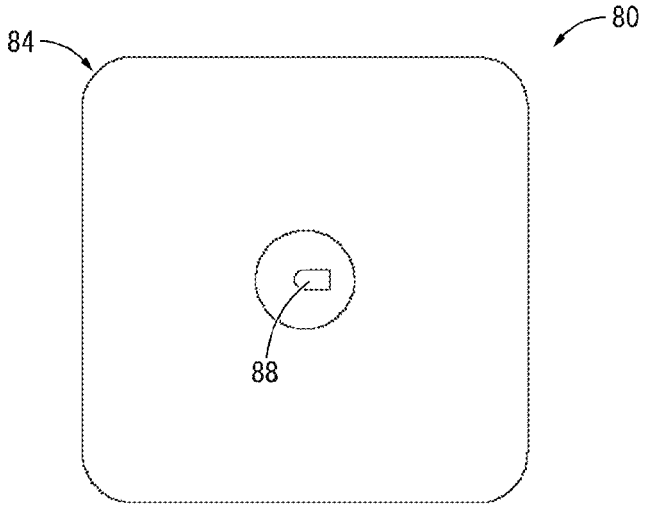
FIG. 21 is a bottom plan view of the cell shown in FIG. 19.
Figure 22:
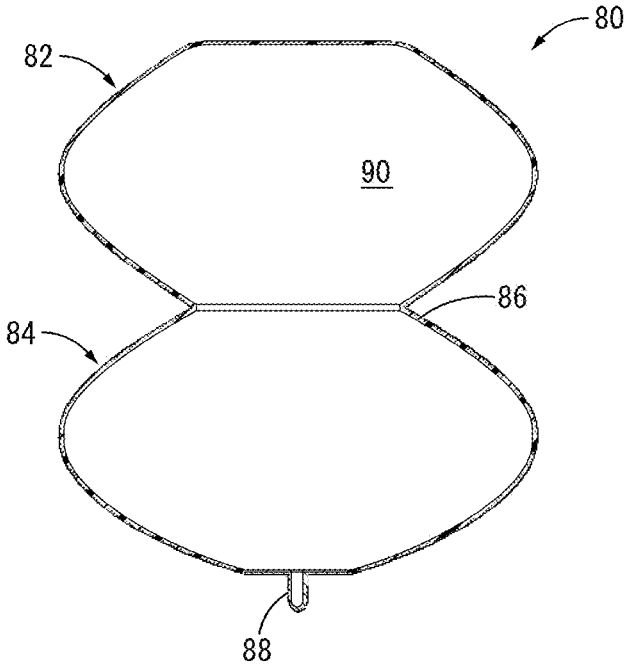
FIG. 22 is a cross sectional view taken along line 22-22 of FIG. 20.
Figure 23:
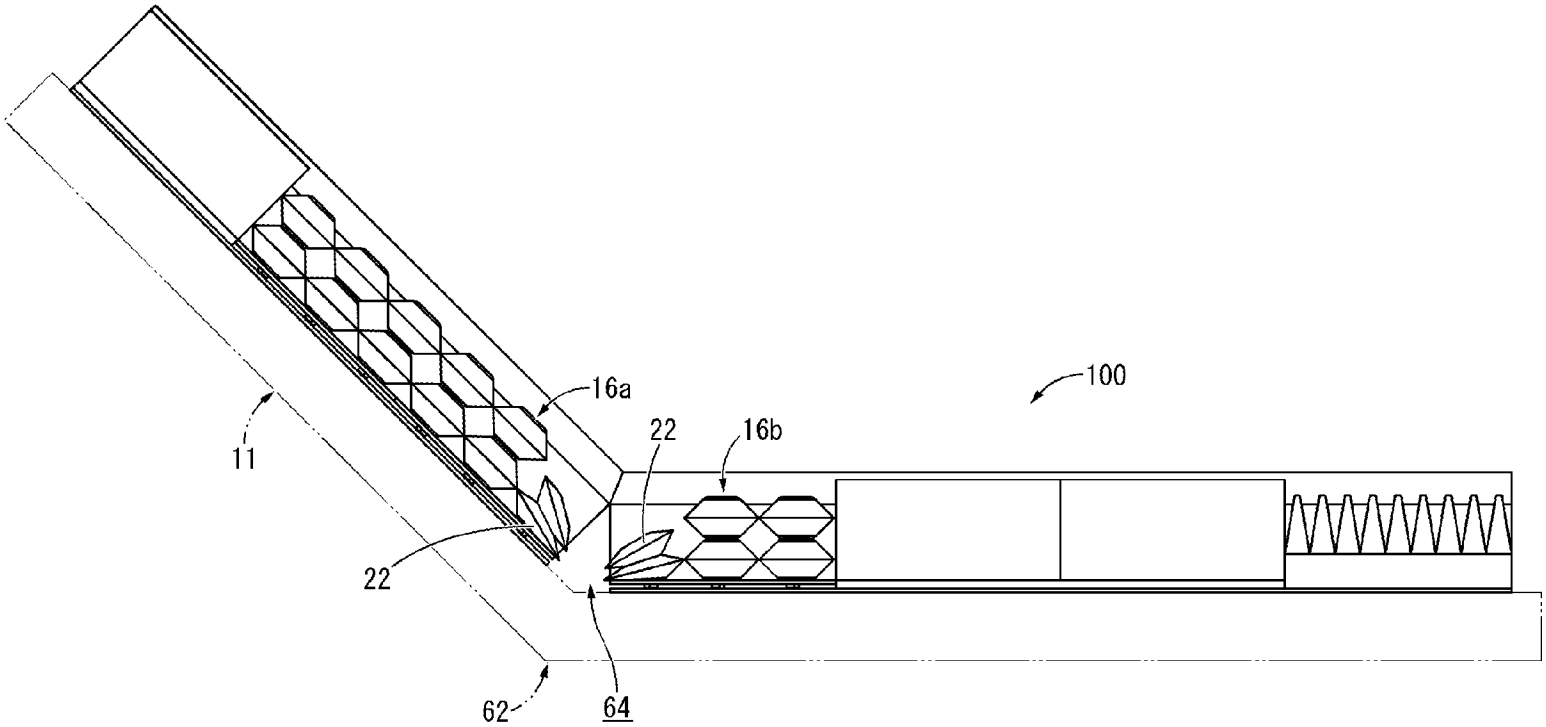
FIG. 23 is a side transparent view showing a mattress of yet another mode in a state of back raising.

Then, a pair of cell units 70*a*, 70*b* that are made independent of each other by the substrate 20 being divided are disposed on the opposite sides with the portion of division of the mattress corresponding to the folding part 62 of the bed 11 interposed therebetween, as in the first embodiment. Accordingly, as depicted in FIGS. 16 through 18, the cell units 70*a*, 70*b* are tiltable relative to each other. Besides, with respect to twelve cells 22 that are adjacent to each other with the portion of division of the cell units 70*a*, 70*b* interposed therebetween, the connecting body 56 is attached as in the first embodiment. In the present embodiment, both of the connecting body 56 and the displacement limiting member 72 are attached to the constricted parts 26 of the cells 22 that are adjacent to each other with the portion of division interposed therebetween. Thus, the connecting body 56 and the displacement limiting member 72 overlap with each other at the portions where they are attached to the cells 22 that are adjacent to each other with the portion of division interposed therebetween.

With the mattress of the present embodiment constructed in the above manner, the amount of relative displacement of the cells 22 within each cell unit 70 is limited by the displacement limiting member 72. Thus, the intervals between the cells 22 that constitute each cell unit 70 are prevented from becoming excessively large, making it possible to prevent the user's body from getting caught between the cells 22. In particular, since the plurality of cells 22 within the cell unit 70 are connected to one another by the displacement limiting member 72, the cells 22 displace or deform in conjunction with one another. Thus, excessive displacement or deformation of the cells 22 with respect to the input is less likely to occur.

Also, in the present embodiment, both the connecting body 56 and the displacement limiting member 72 are attached to the adjacent cells 22 that are adjacent to the portion of division of the mattress. Therefore, when a large force acts on the adjacent cells 22, the force acting on the adjacent cells 22 will be dispersedly transmitted to the other cells 22 by the displacement limiting member 72. This makes it possible to limit displacement of the adjacent cells 22.

Furthermore, since the displacement limiting member 72 has flexibility, relative displacement and deformation of the cells 22 connected to one another by the displacement limiting member 72 are permitted by the flexural deformation of the displacement limiting member 72. In particular, in the structure in which the displacement limiting member 72 is attached to the constricted part 26 of the cell 22 having the upper-lower two-stage structure, when a downward load acts on the upper face of the cell 22, deformation of not only the upper part 28 but also the lower part 30 are permitted by the flexural deformation of the displacement limiting member 72. Thus, height differentials can be largely permitted among the cells 22 that constitute the same cell unit 70, thereby advantageously dispersing the body pressure. By so doing, when a load is input to the adjacent cells 22 from the connecting body 56, the other cells 22, which constitute the same cell unit 70 as the adjacent cells 22, receive the load distributed via the displacement limiting member 72. In addition, excessive restraint of the cells 22 due to the displacement limiting member 72 is avoided, so as to be able to prevent distortional deformation of the upper face of the mattress.

Moreover, since the displacement limiting member 72 has extension and contraction properties, the relative displacement of each cell 22 that constitutes the cell unit 70 is permitted to some extent by the extensional and contractive deformation of the displacement limiting member 72. This makes it possible to prevent the user from getting caught between the cells 22 due to excessive relative displacement of each cell 22 as well as to advantageously disperse the body pressure. Furthermore, when a load is input to the adjacent cells 22 to which the connecting body 56 is attached, the plurality of other cells 22 that are connected to the adjacent cells 22 by the displacement limiting member 72 are each deformable in a relatively free way owing to the extensional and contractive deformation of the displacement limiting member 72. As a specific example, with respect to a force in the planar direction that is transmitted by the displacement limiting member 72, the amount of deformation is made small for the cell 22 whose vertical support load is large, while the amount of deformation is made large for the cell 22 whose vertical support load is small, or the like. By so doing, it is possible to maintain a stable support of the user by the upper face of the mattress as well as to disperse the load.

Additionally, in the present embodiment, the insertion hole 74 of the displacement limiting member 72 is made larger in diameter than the constricted part 26 of the cell 22. Thus, the cell 22 is permitted a certain degree of independent displacement or deformation, thereby excellently exhibiting body pressure dispersion effect.

While the present invention has been described in detail hereinabove in terms of the embodiments, the invention is not limited by the specific disclosures thereof. For example, the cell unit 16 and the division units 18*a* through 18*e* do not have to be continuous entirely in the width direction of the bed, but may alternatively be divided in plurality in the width direction of the bed. In this case, it is desirable that a linking body having the same structure as the connecting body 56 be attached to the cells 22, which are adjacent to each other with the portion of division in the width direction of the bed interposed therebetween, and disposed so as to straddle the portion of division. With this arrangement, the linking body covers a gap between those cells 22, thereby preventing the user's body from getting caught in the gap.

Also, the division units 18*a* through 18*e* are not essential. Namely, the portion constituted by the division units 18*a* through 18*e* in the preceding embodiments can also be constituted by the cell units.

Besides, regarding the cells 22 that constitute the cell unit 16 and the division unit 18*b*, it is not necessary that all of them have roughly the same structure and shape. For example, it would also be acceptable that the cells 22 having a smaller planar shape than that of the cells 22 disposed on both end sections in the width direction of the bed are more disposed on the center section thereof, on which the load of the user concentratedly acts. Body pressure dispersion effect can be more advantageously exhibited thereby.

Furthermore, the connecting body 56 and the displacement limiting member 72 are not necessarily limited to the ones that are provided at the medial portion of the cell 22, as long as they are supported by the cells 22. For example, the connecting body 56 and the displacement limiting member 72 can be provided to the upper ends of the cells 22 by bonding, welding, integrally forming or the like so as to be supported by the upper ends of the cells 22.

Moreover, the connecting body 56 and the displacement limiting member 72 are both not limited to the structure in which a sheet includes the insertion holes. Specifically, for example, it is possible to adopt a structure in which, with respect to the cells 22 that are adjacent to each other with the portion of division corresponding to the folding part 62 interposed therebetween, a cord-shaped or band-shaped connecting body is attached, a structure in which the connecting body is mesh-shaped and the cells 22 are inserted and attached into the mesh pattern, and a structure in which a sheet-formed connecting body includes slits (cuts) formed linearly or radially for inserting the cells 22. In addition, the connecting body 56 or the displacement limiting member 72 may comprise a fabric or knitting (for example, a cloth or the like woven from a natural fiber or a chemical fiber) that includes the insertion holes. Besides, for the connecting body 56 or the displacement limiting member 72, it is also possible to adopt a composite in which a rubber material etc. covers the surface of a fabric, a knitting, or a mesh comprising a fiber or the like. In the case of adopting the fabric or knitting as the connecting body 56 or the displacement limiting member 72, for example, extension and contraction properties can be set by forming the fiber from a material having extension and contraction properties, as well as by means of the method of weaving or knitting. That is, the extension and contraction properties of the connecting body 56 or the displacement limiting member 72 are suitably set depending on the structure, the properties of the forming material, or the like.

It is not necessary for the connecting body 56 to straddle the cells 22 that are arranged in the width direction of the bed, as long as it straddles the cells 22 that are adjacent to each other with the portion of division corresponding to the folding part 62 interposed therebetween. Also, the connecting body 56 does not have to be attached to all of the cells 22 that are adjacent to each other with the portion of division interposed therebetween. For example, it would also be acceptable that the connecting body 56 is selectively attached to the cells 22 that are arranged in the center section in the width direction of the bed where the user's getting caught between the cells 22 can be a problem during back raising.

Additionally, as long as the connecting body is attached to the cells 22 that are adjacent to each other with the portion of division corresponding to the folding part 62 interposed therebetween, the connecting body may be attached to another cell 22 as well. By so doing, the connecting body has a structure that also serves as the displacement limiting member, thereby achieving reduction in the number of parts, a simple structure attendant thereon, and the like. It is possible to attach the connecting body to the cells 22 over any number of rows in the in the length direction of the bed on each of the opposite sides with the folding part 62 interposed therebetween. Besides, the connecting body may also be attached to the cells 22 over mutually different numbers of rows in the length direction of the bed on the opposite sides with the folding part 62 interposed therebetween.

Furthermore, the connecting body 56 or the displacement limiting member 72 may be attached to the substrate 20, the base 46, the division units 18*a* through 18*e* or the like serving as another member. With this configuration, the amount of the movement of the connecting body 56 or the displacement limiting member 72 is limited on the cell unit 16, thereby more advantageously limiting the amount of displacement of the cells 22. Specifically, for example, the connecting body or the displacement limiting member may be fixed to at least one of the division units 18*a*, 18*c* on at least one end in the length direction of the bed. This makes it also possible to limit the amount of the movement of the connecting body or the displacement limiting member due to deviation in the length direction or width direction of the bed on the cell unit 16. The cell 22 may also be indirectly attached to the substrate 20 via the connecting body or the displacement limiting member. The bottom face of the cell 22 does not have to be directly attached to the substrate 20 but may be upwardly remote therefrom. Also, in the structure in which the connecting body or the displacement limiting member is linked to another member, the connecting body or the displacement limiting member may have flexibility or extension and contraction properties. By so doing, it is possible to prevent excessive restraint of the cells 22 due to the connecting body or the displacement limiting member and achieve dispersion of the body pressure, while limiting the amount of the movement of the connecting body or the displacement limiting member with respect to another member.

Moreover, the specific structure of the cell is merely exemplary, and the specific shape is not limited in particular as long as the cell includes the fluid chamber inside thereof and is allowed to undergo extensional and contractive deformation in the vertical direction by means of adjustment of the amount of fluid within the fluid chamber. For example, whereas the preceding embodiments illustrated the cell 22 that is roughly circular in top view, the cell 22 may alternatively be oval, polygonal, irregular-shaped or the like in top view.

Specifically, for example, a cell 80 depicted in FIGS. 19 through 22 can also be adopted. The cell 80 includes an upper part 82 and a lower part 84 each having a hollow bag shape. The upper part 82 and the lower part 84 both have a generally rounded rectangular shape whose corners are arcuately rounded viewed in the axial direction, while including a peripheral wall that is continuous in the peripheral direction with a curved vertical cross section gradually contracting toward axially both ends. Besides, the top face of the upper part 82 and the bottom face of the lower part 84 are each provided with a roughly circular flat portion. The upper part 82 and the lower part 84 are integrally formed in vertically continuous fashion so as to constitute the two-stage bag-shaped cell 80, and at the portion where the upper part 82 and the lower part 84 are continuous, formed is a constricted part 86 whose transverse cross section is made small. Additionally, on the bottom wall of the cell 80, there is formed an inlet/outlet port 88 to be connected to the pipeline 36, and inlet and outlet of the air or the like are allowable via the inlet/outlet port 88 with respect to a fluid chamber 90 provided inside of the cell 80. The cell 80 of this construction as shown in FIGS. 19 through 22 can also be adopted instead of or in addition to the cell 22 of the preceding embodiments. With the cell 80 as well, the same as the cell 22 of the preceding embodiments, the upper part 82 and the lower part 84 may be separately formed by, for each of the upper part 82 and the lower part 84, a plurality of synthetic resin sheets being bonded or welded at their outer peripheral portions, and then the upper part 82 and the lower part 84 may be secured to each other so as to form the cell 80. Alternatively, the upper part 82 and the lower part 84 may be integrally formed by vacuum forming or the like.

What is claimed is:

1. A mattress comprising:

substrates configured to support a human body; and a plurality of cells arranged on an upper face of each substrate, the cells including respective fluid chambers, wherein the substrates are divided from each other at a location corresponding to a folding part provided to a portion of a bed in a length direction thereof such that cell units are constituted by the respective substrates and the cells arranged thereon, the cell units are disposed such that the cell units are adjacent to each other with the folding part interposed therebetween, and a connecting body is disposed between the cell units such that the connecting body straddles the cell units and is supported by the cells of the cell units, wherein each cell includes a lower part having a bottom wall and a top wall thereof, an upper part having a bottom wall and a top wall thereof, the top wall of the lower part and the bottom wall of the upper part secured together and forming a constricted part having a small cross-sectional shape at a vertically medial portion between the lower part and the upper part.

2. The mattress according to claim 1, wherein the connecting body is attached to the constricted part of the cells.

3. The mattress according to claim 1, further comprising a displacement limiter that limits an amount of relative displacement of the cells within the cell units.

4. The mattress according to claim 3, wherein the displacement limiter is attached to the constricted part of the cells.

5. The mattress according to claim 3, wherein the displacement limiter is linked to another member such that an amount of movement of the displacement limiter is limited on the cell units.

6. The mattress according to claim 3, wherein the displacement limiter has flexibility.

7. The mattress according to claim 6, wherein the displacement limiter has extension and contraction properties.

8. The mattress according to claim 1, wherein the connecting body has flexibility.

9. The mattress according to claim 8, wherein the connecting body has extension and contraction properties.

10. The mattress according to claim 8, wherein the connecting body comprises a sheet that includes a plurality of holes through which the cells are inserted.

11. The mattress according to claim 1, wherein the cell units that are adjacent to each other with the folding part interposed therebetween in the length direction of the bed are continuous entirely in a width direction of the bed.

12. The mattress according to claim 1, wherein the mattress is divided at a location away from the folding part in the length direction of the bed.

13. The mattress according to claim 1, wherein the cell units each include the cells that are arranged in a plurality of rows in the length direction of the bed and in a plurality of columns in a width direction of the bed.

14. A mattress comprising:

substrates configured to support a human body; and a plurality of cells arranged on an upper face of each substrate, the cells including respective fluid chambers, wherein the substrates are divided from each other at a location corresponding to a folding part provided to a portion of a bed in a length direction thereof such that cell units are constituted by the respective substrates and the cells arranged thereon, the cell units are disposed such that the cell units are adjacent to each other with the folding part interposed therebetween, and a connecting body is disposed between the cell units such that the connecting body straddles the cell units and is supported by the cells of the cell units, wherein the connecting body has flexibility, and wherein the connecting body comprises a sheet that includes a plurality of holes through which the cells are inserted.

* * * * *